US005364726A

United States Patent [19]

Morrison et al.

[11] Patent Number: 5,364,726

[45] Date of Patent: Nov. 15, 1994

[54] LIQUID DEVELOPERS HAVING CURABLE LIQUID VEHICLES

[75] Inventors: Ian D. Morrison; Bing R. Hsieh; Jerry H. Taylor, all of Webster, N.Y.

[73] Assignee: Xerox Corporation, Stamford, Conn.

[21] Appl. No.: 17,055

[22] Filed: Feb. 2, 1993

Related U.S. Application Data

[60] Division of Ser. No. 654,693, Feb. 13, 1991, abandoned, which is a continuation-in-part of Ser. No. 501,585, Mar. 30, 1990, abandoned.

[51] Int. Cl.[5] ..... G03G 9/125

[52] U.S. Cl. ..... 430/115; 430/119

[58] Field of Search ..... 430/115, 119

[56] References Cited

FOREIGN PATENT DOCUMENTS 63-155055 6/1988 Japan .

*Primary Examiner*—John Goodrow
*Attorney, Agent, or Firm*—Judith L. Byorick

[57] ABSTRACT

Disclosed is a liquid developer comprising a colorant and a substantial amount of a curable liquid vehicle having a viscosity of no more than about 500 centipoise and a resistivity of no less than about $10_8$ ohm-cm. One embodiment of the invention is directed to an electrophoretic liquid developer comprising a substantial amount of a curable liquid vehicle having a viscosity of no more than about 20 centipoise and a resistivity of no less than about $5\times10^9$ ohm-cm, a charge control agent, and colored particles capable of becoming charged and migrating through the liquid vehicle to develop an electrostatic latent image. Another embodiment of the invention is directed to a polarizable liquid developer comprising a colorant and a substantial amount of a curable liquid vehicle having a viscosity of from about 25 to about 500 centipoise and a resistivity of from about $10^8$ to about $10^{11}$ ohm-cm. Yet another embodiment of the invention is directed to a photoelectrophoretic liquid developer comprising a substantial amount of a curable liquid vehicle having a viscosity of no more than about 20 centipoise and a resistivity of no less than about $5\times10^9$ ohm-cm and photosensitive colored particles. A specific embodiment of the invention is directed to a liquid developer comprising a colorant, a substantial amount of a curable liquid vehicle having a viscosity of no more than about 500 centipoise and a resistivity of no less than about $10^8$ ohm-cm, and solid particles containing an initiator substantially insoluble in the liquid vehicle and capable, upon activation, of initiating polymerization of the curable liquid vehicle. In one embodiment, the colorant comprises pigment particles and the initiator is contained on the surfaces of the pigment particles. In another embodiment, the developer contains polymeric particles and the initiator is contained on the surfaces of the polymeric particles. In yet another embodiment, the colorant comprises toner particles which comprise a pigment and a polymer, and the initiator is contained on the surfaces of the toner particles. In still another embodiment, the initiator is contained on the surfaces of solid particles such as silicas, clays, or the like. The initiator can also be contained within the solid particles.

20 Claims, No Drawings

LIQUID DEVELOPERS HAVING CURABLE LIQUID VEHICLES

This is a division of application Ser. No. 07/654,693, filed Feb. 13, 1991 now abandoned, which is a continuation-in-part of copending application U.S. Ser. No. 07/501,585 filed Mar. 30, 1990, now abandoned, entitled "Liquid Developers Having Curable Liquid Vehicles", the disclosure of which is totally incorporated herein by reference.

BACKGROUND OF THE INVENTION

The present invention is directed to liquid developer compositions suitable for the development of electrostatic latent images. More specifically, the present invention is directed to liquid developers having curable liquid vehicles. One embodiment of the present invention is directed to a liquid developer comprising a colorant and a substantial amount of a curable liquid vehicle having a viscosity of no more than about 500 centipoise and a resistivity of no less than about $10^8$ ohm-cm. In one specific embodiment, the invention comprises an electrophoretic liquid developer comprising a substantial amount of a curable liquid vehicle having a viscosity of no more than about 20 centipoise and a resistivity of no less than about $5\times10^9$ ohm-cm, a charge control agent, and colored particles capable of becoming charged and migrating through the liquid vehicle to develop an electrostatic latent image. Another specific embodiment of the present invention is directed to a liquid developer suitable for polarizable liquid development comprising a colorant and a substantial amount of a curable liquid vehicle having a viscosity of from about 25 to about 500 centipoise and a resistivity of from about $10^8$ to about $10^{11}$ ohm-cm. Still another specific embodiment of the present invention is directed to a photoelectrophoretic liquid developer comprising a substantial amount of a curable liquid vehicle having a viscosity of no more than about 20 centipoise and a resistivity of no less than about $5\times10^9$ ohm-cm, and photosensitive colored particles capable of becoming charged and migrating through the liquid vehicle upon exposure to radiation to form an image. Advantages of the present invention include the reduction or substantial elimination of solvent vapor emissions from copiers or printers employing these liquid developers, the reduction or substantial elimination of solvent vapor emissions from documents prepared by liquid development processes employing these liquid developers, and the reduction of solvent disposal from liquid development apparatuses.

Additional specific embodiments of the present invention are directed to liquid developers having curable liquid vehicles and heterogeneous polymerization initiators. One embodiment of the present invention is directed to a liquid developer comprising a colorant, a substantial amount of a curable liquid vehicle having a viscosity of no more than about 500 centipoise and a resistivity of no less than about $10^8$ ohm-cm, and solid particles containing an initiator substantially insoluble in the liquid vehicle and capable, upon activation, of initiating polymerization of the curable liquid vehicle. In one specific embodiment, the invention comprises an electrophoretic liquid developer comprising a substantial amount of a curable liquid vehicle having a viscosity of no more than about 20 centipoise and a resistivity of no less than about $5\times10^9$ ohm-cm, a charge control agent, colored particles capable of becoming charged and migrating through the liquid vehicle to develop an electrostatic latent image, and solid particles containing an initiator substantially insoluble in the liquid vehicle and capable, upon activation, of initiating polymerization of the curable liquid vehicle. The solid particles may be the colored particles that become charged or may be particles of a material other than the colored particles that become charged. Another specific embodiment of the present invention is directed to a liquid developer suitable for polarizable liquid development comprising a colorant, a substantial amount of a curable liquid vehicle having a viscosity of from about 25 to about 500 centipoise and a resistivity of from about $10^8$ to about $10^{11}$ ohm-cm, and solid particles containing an initiator substantially insoluble in the liquid vehicle and capable, upon activation, of initiating polymerization of the curable liquid vehicle. Still another specific embodiment of the present invention is directed to a photoelectrophoretic liquid developer comprising a substantial amount of a curable liquid vehicle having a viscosity of no more than about 20 centipoise and a resistivity of no less than about $5\times10^9$ ohm-cm, photosensitive colored particles capable of becoming charged and migrating through the liquid vehicle upon exposure to radiation to form an image, and solid particles containing an initiator substantially insoluble in the liquid vehicle and capable, upon activation, of initiating polymerization of the curable liquid vehicle.

Advantages of curable liquid developers include the reduction or substantial elimination of solvent vapor emissions from copiers or printers employing these liquid developers, the reduction or substantial elimination of solvent vapor emissions from documents prepared by liquid development processes employing these liquid developers, and the reduction of solvent disposal from liquid development apparatuses. The present invention, in which the liquid developers contain a heterogeneous polymerization initiator contained on or in solid particles in the developer, has the additional advantages of enabling polymerization of liquids with initiators not soluble in the liquid and elimination of the need for solubilizing solvents or derivatization of the initiator to render the initiator soluble in the liquid monomer. The use of a substantially insoluble initiator enables a wide range of choices of liquids and initiators. In addition, the use of a substantially insoluble initiator prevents adverse effects on the conductivity of the liquid vehicle as a result of the presence either of a soluble initiator or of an initially insoluble initiator and a solubilizing agent.

Curable inks are known in the printing industry. For example, U.S. Pat. No. 4,680,368 (Nakamoto et al.), the disclosure of which is totally incorporated herein by reference, discloses an ultraviolet curable ink composition comprising a polyurethane polymethacrylate obtained by reacting a polyisocyanate compound of the formula

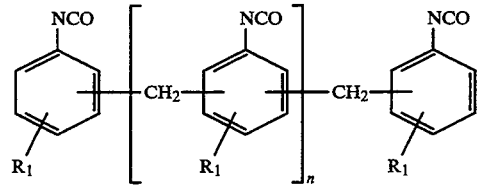

wherein $R_1$ is a hydrogen atom or a methyl group, and n is an integer of from 1 to 20, with a hydroxyl group containing methacrylate and having in one molecule at least two methacryloyl groups and at least two urethane bonds, a radical polymerizable low molecular weight compound, and a photopolymerization initiator.

In addition, U.S. Pat. No. 4,443,495 (Morgan et al.), the disclosure of which is totally incorporated herein by reference, discloses a heat curable conductive ink which comprises (1) an ethylenically unsaturated member of the group consisting of (a) a liquid ethylenically unsaturated monomer, oligomer, or prepolymer of the formula

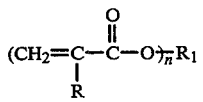

wherein R is H or $CH_3$, $R_1$ is an organic moiety and n is at least 2, (b) a polythiol in combination with (a), a polythiol in combination with a liquid ethylenically unsaturated monomer, oligomer, or prepolymer of the formula

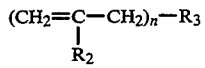

wherein $R_2$ is H or $CH_3$, $R_3$ is an organic moiety and n is at least 2, and (d) mixtures of (a), (b), and (c); (2) a thermal initiator; and (3) an electrically conductive material. Heating of the composition in a desired pattern on a substrate results in a printed electric circuit.

Further, U.S. Pat. No. 4,751,102 (Adair et al.), the disclosure of which is totally incorporated herein by reference, discloses a radiation curable ink composition comprising pigment and a photohardenable composition, wherein the photohardenable composition comprises a free radical addition polymerizable or crosslinkable compound and an ionic dye reactive counter ion compound which is capable of absorbing actinic radiation and producing free radicals which initiate free radical polymerization or crosslinking of the polymerizable or crosslinkable compound.

Additionally, U.S. Pat. No. 4,334,970 (Lombardi et al.), the disclosure of which is totally incorporated herein by reference, discloses a photosensitive resin system that is essentially solvent free and contains an ester produced from an unsaturated organic acid and a polyhydroxyl containing material, a photoinitiator, a carbonyl initiator, a monomer capable of reacting with an acrylic monomer, and an unsaturated hydroxyl containing polymer hydrocarbon.

Further, "Photochemical Aspects of UV Curing," Y.C. Chang, *Photographic Science and Engineering*, Vol. 21, No. 6 (1977) discloses the electro-optical properties of UV-curing materials, the effect of pigment dispersion on the curing rate of inks containing pigments, and the spectroscopic calibration of the degree of UV cure.

U.S. Pat. Nos. 3,661,614, 4,003,868, and 4,215,167, the disclosures of which are totally incorporated herein by reference, also disclose ultraviolet curable printing inks.

U.S. Pat. No. 4,399,209 (Sanders et al.), the disclosure of which is totally incorporated herein by reference, discloses a transfer imaging system wherein images are formed by imagewise exposing a layer comprising a chromogenic material and pressure rupturable capsules containing, as an internal phase, a photosensitive composition. When a coated composition containing the chromogenic material and the encapsulated photosensitive composition is exposed to actinic radiation and the capsules are subsequently ruptured in the presence of a developer, the image-forming reaction between the chromogenic material and the developer discriminately occurs in the exposed or unexposed areas and produces a detectable image. This result is accomplished by controlling whether the chromogenic material can transfer from the imaging sheet to the developer sheet. Generally, the photosensitive composition has a viscosity that changes upon exposure to actinic radiation such that upon exposure there is a change in the viscosity of the internal phase in the exposed areas which imagewise determines whether the chromogenic material is accessible to the developer. The photosensitive composition may be a radiation curable composition which, upon exposure to light, increases in viscosity and immobilizes the chromogenic material, thereby preventing it from transferring to the developer sheet and reacting with the developer material. Alternatively, the chromogenic material can be encapsulated with a substance which is depolymerized or otherwise decreased in molecular weight upon exposure, resulting in a decrease in viscosity which renders the chromogenic material accessible or transferrable to the developer in the exposed areas.

Liquid developers and liquid development processes for the development of electrostatic latent images are also known. In electrophoretic developers and processes, the liquid developers generally comprise a liquid vehicle and colored toner particles, and frequently also contain a charge control agent. The colored toner particles become charged, and upon contacting the electrostatic latent image with the liquid developer, the particles migrate through the liquid vehicle toward the charged image, thereby effecting development. Any residual liquid vehicle remaining on the image subsequent to development is evaporated or absorbed into the receiving sheet. Typically, liquid developers employ hydrocarbon liquid vehicles, most commonly high boiling aliphatic hydrocarbons that are relatively high in resistivity and nontoxic. Developers and processes of this type are disclosed in, for example, U.S. Pat. Nos. 4,476,210, 2,877,133, 2,890,174, 2,899,335, 2,892,709, 2,913,353, 3,729,419, 3,841,893, 3,968,044, 4,794,651, 4,762,764, 4,830,945, 4,686,936, 4,766,049, 4,707,429, 4,780,388, 3,976,808, 4,877,698, 4,880,720, 4,880,432, and copending application U.S. Ser. No. 07/300,395, the disclosures of each of which are totally incorporated herein by reference.

In polarizable liquid development processes, as disclosed in U.S. Pat. No. 3,084,043 (Gundlach), the disclosure of which is totally incorporated herein by reference, liquid developers having relatively low viscosity and low volatility and relatively high electrical conductivity (relatively low volume resistivity) are deposited on a gravure roller to fill the depressions in the roller surface. Excess developer is removed from the lands between the depressions, and as a receiving surface charged in image configuration passes near the gravure roller, liquid developer is attracted from the depressions onto the receiving surface in image configuration by the charged image. Developers and processes of this type are disclosed in, for example, U.S. Pat. Nos. 4,047,943, 4,059,444, 4,822,710, 4,804,601, 4,766,049, Canadian Patent 37,823, Canadian Patent 926,182, Canadian Patent 942,554, British Patent 1,321,286, and British Patent 1,312,844, the disclosures of each of which are totally incorporated herein by reference.

In photoelectrophoretic liquid development processes, as disclosed in, for example, U.S. Pat. Nos. 4,135,925, 3,383,993, 3,384,488, 3,384,565, 3,384,566, 4,043,655, and 4,023,968, the disclosures of each of which are totally incorporated herein by reference, colored photosensitive toner particles are suspended in an insulating carrier liquid. The suspension is placed between at least two electrodes subjected to a potential difference and exposed to a light image. Typically, the imaging suspension is placed on a transparent electrically conductive support in the form of a thin film and exposure is made through the transparent support while a second biased electrode is rolled across the suspension. It is believed that the particles bear an initial charge once suspended in the liquid carrier which causes them to be attracted to the transparent base electrode upon application of the potential difference. Upon exposure, the particles change polarity by exchanging charge with the base electrode so that the exposed particles migrate to the second or roller electrode, thereby forming images on each of the electrodes by particle subtraction, each image being complementary one to the other. Both polychromatic and monochromatic images can be formed by the process; when polychromatic images are prepared, the liquid developer can contain toner particles of more than one color.

The following publication has been discovered and is believed to be of background interest with respect to the present application. C.C. Chow, "Ultra-Violet Curable Liquid Immersion Development Toner," Xerox Disclosure Journal, Volume 1, Number 5, page 49 (1976) discloses a liquid immersion development process using a toner consisting of a viscous ultraviolet curable liquid polymer, said toner being dispersed in a carrier fluid and used in the conventional way. The print is exposed to ultraviolet light to convert the liquid toner into a non-tacky solid. The carrier fluid is then evaporated from the imaging member surface by warm air and condensed within the copying machine. The ultraviolet curable polymer is then transferred to paper and fixed by exposure to ultraviolet radiation. The process is such that solvent recovery is necessary only inside the machine and solvent does not become absorbed into the paper.

Additional liquid developers containing curable resins in a liquid vehicle, such as an aliphatic hydrocarbon, are as disclosed in Japanese Patent 62-115 171, Japanese Patent 62-018 575, Japanese Patent 62-018 574, Japanese Patent 61-156 264, Japanese Patent 61 - 156 263, Japanese Patent 61-156 262, Japanese Patent 61-156 261, Japanese Patent 61-060 714, Japanese Patent 63-155 055, and Japanese Patent 62-098 364. In addition, U.S. Pat. No. 4,764,447, Japanese Patent 62-007 718, Japanese Patent 62-007 717, Japanese Patent 62-007 716, Japanese Patent 62-004 714, Japanese Patent 61-020 056, and Japanese Patent 60-249 156 disclose processes for polymerizing monomers in a hydrocarbon liquid vehicle to form dispersions of polymer particles suitable for use as liquid developers. Further, Japanese Patent 62-014168 discloses an encapsulated toner contained in a liquid vehicle. The capsule core can be cured by heat, and the monomers or oligomers become fixed to paper when images developed with the developer are cured.

Further, heterogeneous catalyst systems are known. For example, U.S. Pat. No. 4,677,137 (Bany et al.), the disclosure of which is totally incorporated herein by reference, discloses supported initiators for the radiation activated polymerization of cationically polymerizable compounds, particularly epoxide group containing compounds. The supported initiators comprise a particulate carrier and a photocatalytic ionic salt. The supported initiators are particularly useful for the polymerization of cationically polymerizable compounds in which the ionic salt alone is not soluble; the initiator is supported on dispersible carrier material, which overcomes the problem of insolubility in epoxypolysiloxane.

In addition, U.S. Pat. No. 3,513,109 (Stiles), the disclosure of which is totally incorporated herein by reference, discloses a method of applying catalytic materials to a support, particularly supports having smooth surfaces of low surface area, by slurrying a finely divided form of the catalytic material in a solution of a metal ammine, applying the slurry to the support, drying, and calcining. In a preferred aspect, the catalytic material applied contains interspersants to stabilize the catalyst from crystal growth at high temperatures.

One difficulty frequently encountered with the use of liquid electrophoretic developers is an objectionable odor that typically accompanies liquid development processes. The sources of this odor are solvent vapors emitted from the copier or printer and the slow release of vapor from residual liquid vehicle remaining on the receiver sheet. A file drawer containing several documents prepared by liquid development processes can accumulate vapor to an unacceptable level. Accordingly, the reduction of solvent vapor emissions from liquid developing machines and from prints prepared with liquid developers is highly desirable for environmental and aesthetic purposes. These difficulties can be overcome with liquid developers having curable liquid vehicles. Curable liquid developers and development processes employing curable liquid developers can produce prints with little or substantially no odor, reduce or substantially eliminate the emission or carryout of solvent vapors from copiers and printers employing liquid development processes, reduce or eliminate the need to dispose of solvents from a copier or printer employing liquid development, enable formation of images with excellent fix to a substrate, and enable simplified containment and capture procedures for reducing or eliminating solvent emissions for copiers or printers employing liquid development.

A difficulty remains, however, with respect to curable liquid developers in that curable liquids suitable for use as the vehicle in a liquid developer are limited since the curable liquid must meet stringent viscosity and conductivity requirements. When the liquid is cured by polymerization via a homogeneous initiator, the choice of liquid vehicle is further restricted to liquids in which a suitable polymerization initiator is soluble, or restricted to those soluble initiators that do not force the conductivity value of the liquid vehicle outside of the desired range, or for which suitable solubilizing solvents or derivitazation of the initiator can render a suitable initiator soluble in the liquid.

Although known materials are suitable for their intended purposes, a need continues to exist for liquid developer compositions that produce prints with little or substantially no odor. A need also remains for liquid developer compositions that reduce or substantially eliminate the emission or carryout of solvent vapors from copiers and printers employing liquid development processes. Further, there is a need for liquid developer compositions that have curable liquid vehicles and that enable generation of high quality images. Additionally, a need exists for liquid developers and liquid development techniques that reduce or eliminate the need to dispose of solvents from a copier or printer employing liquid development. Further, there is a need for liquid developers and liquid development processes that enable formation of images with excellent fix to a substrate. In addition, a need remains for liquid developers and liquid development processes that enable simplified containment and capture procedures for reducing or eliminating solvent emissions for copiers or printers employing liquid development. Additionally, a need remains for curable liquid developers containing an initiator in substantially insoluble form. In addition, a need remains for curable liquid developers for which the choice of suitable vehicles is expanded. Further, there is a need for curable liquid developers for which no solubilizing solvent is required to solubilize the polymerization initiator in the monomer. A need also remains for curable liquid developers for which there is no need to prepare a derivative of a suitable initiator for the purpose of rendering the initiator soluble in the monomer. Additionally, a need exists for curable liquid developers containing heterogeneous initiators for which the desired developer color, hue, and tint remain unimpaired.

SUMMARY OF THE INVENTION

It is an object of the present invention to provide liquid developer compositions that produce prints with little or substantially no odor.

It is another object of the present invention to provide liquid developer compositions that reduce or substantially eliminate the emission or carryout of solvent vapors from copiers and printers employing liquid development processes.

It is yet another object of the present invention to provide liquid developer compositions that have curable liquid vehicles and that enable generation of high quality images.

It is still another object of the present invention to provide liquid developers and liquid development techniques that reduce or eliminate the need to dispose of solvents from a copier or printer employing liquid development.

Another object of the present invention is to provide liquid developers and liquid development processes that enable formation of images with excellent fix to a substrate.

Yet another object of the present invention is to provide liquid developers and liquid development processes that enable simplified containment and capture procedures for reducing or eliminating solvent emissions for copiers or printers employing liquid development.

It is another object of the present invention to provide curable liquid developers containing an initiator in substantially insoluble form.

It is yet another object of the present invention to provide curable liquid developers for which the choice of suitable vehicles is expanded.

It is still another object of the present invention to provide curable liquid developers for which no solubilizing solvent is required to solubilize the polymerization initiator in the monomer.

Another object of the present invention is to provide curable liquid developers for which there is no need to prepare a derivative of a suitable initiator for the purpose of rendering the initiator soluble in the monomer.

Yet another object of the present invention is to provide curable liquid developers containing heterogeneous initiators for which the desired developer color, hue, and tint remain unimpaired.

These and other objects of the present invention (or specific embodiments thereof) can be achieved by providing a liquid developer which comprises a colorant and a substantial amount of a curable liquid vehicle having a resistivity of no less than about $10^8$ ohm-cm and a viscosity of no more than about 500 centipoise. One specific embodiment of the present invention is directed to a liquid electrophoretic developer which comprises a substantial amount of a curable liquid vehicle having a resistivity of no less than about $5\times10^9$ ohm-cm and a viscosity of no more than about 20 centipoise, a charge control agent, and colored particles capable of becoming charged and migrating through the liquid vehicle to develop an electrostatic latent image. Another specific embodiment of the present invention is directed to a liquid developer which comprises a colorant and a substantial amount of a curable liquid vehicle having a resistivity of from about $10^8$ to about $10^{11}$ ohm-cm and a viscosity of from about 25 to about 500 centipoise. Yet another specific embodiment of the present invention is directed to a liquid photoelectrophoretic developer which comprises a substantial amount of a curable liquid vehicle having a resistivity of no less than about $5\times10^9$ ohm-cm and a viscosity of no more than about 20 centipoise and photosensitive colored particles. Still another embodiment of the present invention is directed to a process which comprises generating an electrostatic latent image, developing the image with an electrophoretic liquid developer which comprises a substantial amount of a curable liquid vehicle having a viscosity of no more than about 20 centipoise and a resistivity of no less than about $5\times10^9$ ohm-cm, a charge control additive, and colored particles capable of becoming charged and migrating through the liquid vehicle, and curing the liquid vehicle remaining on the developed image subsequent to development. Curing can take place at any time before or after transfer of the developed image to a substrate. Transfer to a substrate is optional, and imaging and development may take place on the substrate as, for example, when direct marking imaging techniques are employed. Another embodiment of the present invention is directed to a process which comprises generating an electrostatic latent image on an imaging member, providing an applicator having raised areas and depressed areas, applying to the depressed areas of the applicator a liquid developer comprising a colorant and a substantial amount of a curable liquid vehicle having a resistivity of from about $10^8$ to about $10^{11}$ ohm-cm and a viscosity of from about 25 to about 500 centipoise, contacting the raised portions of the applicator with the imaging member to cause the image to attract the developer from the depressed portions of the applicator onto the latent image, thereby developing the image, and curing the liquid vehicle remaining on the developed image. Yet another embodiment of the present invention is directed to a process which comprises placing a liquid developer comprising a substantial amount of a curable liquid vehicle having a resistivity of no less than about $5\times10^9$ ohm-cm and a viscosity of no more than about 20 centipoise and photosensitive colored particles between at least two electrodes, exposing the developer between the electrodes to a light image while applying a potential between the electrodes, thereby causing the formation of an image by deposition of the suspended particles in imagewise configuration on the electrodes, and curing the liquid vehicle remaining on the developed image.

Another specific embodiment of the present invention is directed to a liquid developer which comprises a colorant, a substantial amount of a curable liquid vehicle having a resistivity of no less than about $10^8$ ohm-cm and a viscosity of no more than about 500 centipoise, and solid particles containing an initiator substantially insoluble in the liquid vehicle and capable, upon activation, of initiating polymerization of the curable liquid vehicle. Yet another specific embodiment of the present invention is directed to a liquid electrophoretic developer which comprises a substantial amount of a curable liquid vehicle having a resistivity of no less than about $5\times10^9$ ohm-cm and a viscosity of no more than about 20 centipoise, a charge control agent, colored particles capable of becoming charged and migrating through the liquid vehicle to develop an electrostatic latent image, and solid particles containing an initiator substantially insoluble in the liquid vehicle and capable, upon activation, of initiating polymerization of the curable liquid vehicle. Another specific embodiment of the present invention is directed to a liquid developer which comprises a colorant, a substantial amount of a curable liquid vehicle having a resistivity of from about $10^8$ to about $10^{11}$ ohm-cm and a viscosity of from about 25 to about 500 centipoise, and solid particles containing an initiator substantially insoluble in the liquid vehicle and capable, upon activation, of initiating polymerization of the curable liquid vehicle. Yet another specific embodiment of the present invention is directed to a liquid photoelectrophoretic developer which comprises a substantial amount of a curable liquid vehicle having a resistivity of no less than about $5\times10^9$ ohm-cm and a viscosity of no more than about 20 centipoise, photosensitive colored particles, and solid particles containing an initiator substantially insoluble in the liquid vehicle and capable, upon activation, of initiating polymerization of the curable liquid vehicle.

Still another embodiment of the present invention is directed to a process which comprises generating an electrostatic latent image, developing the image with an electrophoretic liquid developer which comprises a substantial amount of a curable liquid vehicle having a viscosity of no more than about 20 centipoise and a resistivity of no less than about $5\times10^9$ ohm-cm, a charge control additive, colored particles capable of becoming charged and migrating through the liquid vehicle, and solid particles containing an initiator substantially insoluble in the liquid vehicle and capable, upon activation, of initiating polymerization of the curable liquid vehicle, and curing the liquid vehicle remaining on the developed image subsequent to development. Curing can take place at any time before or after transfer of the developed image to a substrate. Transfer to a substrate is optional, and imaging and development may take place on the substrate as, for example, when direct marking imaging techniques are employed. Another embodiment of the present invention is directed to a process which comprises generating an electrostatic latent image on an imaging member, providing an applicator having raised areas and depressed areas, applying to the depressed areas of the applicator a liquid developer comprising a colorant, a substantial amount of a curable liquid vehicle having a resistivity of from about $10^8$ to about $10^{11}$ ohm-cm and a viscosity of from about 25 to about 500 centipoise, and solid particles containing an initiator substantially insoluble in the liquid vehicle and capable, upon activation, of initiating polymerization of the curable liquid vehicle, contacting the raised portions of the applicator with the imaging member to cause the image to attract the developer from the depressed portions of the applicator onto the latent image, thereby developing the image, and curing the liquid vehicle remaining on the developed image. Yet another embodiment of the present invention is directed to a process which comprises placing a liquid developer comprising a substantial amount of a curable liquid vehicle having a resistivity of no less than about $5\times10^9$ ohm-cm and a viscosity of no more than about 20 centipoise, photosensitive colored particles, and solid particles containing an initiator substantially insoluble in the liquid vehicle and capable, upon activation, of initiating polymerization of the curable liquid vehicle between at least two electrodes, exposing the developer between the electrodes to a light image while applying a potential between the electrodes, thereby causing the formation of an image by deposition of the suspended particles in imagewise configuration on the electrodes, and curing the liquid vehicle remaining on the developed image.

The liquid vehicle of the present invention can be any suitable liquid having the desired resistivity and viscosity characteristics and capable of becoming cured to form a solid. In a specific embodiment of the invention, the liquid is capable of becoming cured to form a solid when an initiator contained either within or on the surfaces of solid particles in the developer initiates polymerization of the liquid. When the liquid developer is intended for use in electrophoretic development or photoelectrophoretic development systems, the liquid vehicle must be capable of permitting the colored toner particles of the developer to migrate through the vehicle to develop electrostatic latent images. Thus, in electrophoretic and photoelectrophoretic developers, the liquid vehicle is sufficiently high in resistivity to enhance the development of particles over that of free ions, typically having a resistivity of more than about $5\times10^9$ ohm-cm and preferably more than about $10^{10}$ ohm-cm as measured by determining the average current flowing across a 1.5 millimeter gap at 5 hertz and 5 volts square wave applied potential. In addition, the liquid vehicle is sufficiently low in viscosity to permit the toner particles to migrate toward the electrostatic latent image with sufficient rapidity to enable development of the image within the desired development time. Typically, the liquid vehicle has a viscosity of no more than about 20 centipoise at the operating temperature of the copier or printer, and preferably no more than about 3 centipoise at the machine operating temperature.

When the liquid developer is intended for use in a polarizable liquid development system, the liquid developer is applied to an applicator such as a gravure roll and brought near an electrostatic latent image. The charged image polarizes the liquid developer in the depressions in the applicator, thereby drawing the developer from the depressions and causing it to flow to the image bearing member to develop the image. For this application, the liquid vehicle of the liquid developer is somewhat more viscous than is the situation with electrophoretic development, since particle migration within the developer is generally not necessary and since the liquid developer must be sufficiently viscous to remain in the depressions in the applicator prior to development. The viscosity, however, remains significantly lower than that typically observed for many printing inks, since the liquid developer must be capable of being pulled from the depressions in the applicator roll by the force exerted by the electrostatic latent image. Thus, liquid developers for use in polar development systems typically have a viscosity of from about 25 to about 500 centipoise at the operating temperature of the copier or printer, and preferably from about 30 to about 300 centipoise at the machine operating temperature. In addition, liquid developers intended for use in polarizable liquid development systems typically have a resistivity lower than liquid developers employed in electrophoretic or photoelectrophoretic development systems to enable the developer to become polarized upon entering proximity with the electrostatic latent image. The liquid developers of the present invention, however, generally have resistivities that are significantly higher than the resistivities of typical printing inks, for which resistivities generally are substantially less than about $10^9$ ohm-cm. Typically, liquid developers for polarizable liquid development systems have a resistivity of from about $10^8$ to about $10^{11}$ ohm-cm, and preferably from about $2\times10^9$ to about $10^{10}$ ohm-cm.

Typical liquids suitable as the curable liquid vehicle of the developers of the present invention include ethylenically unsaturated compounds, including monomers, dimers, or oligomers having one or more ethylenically unsaturated groups such as vinyl or allyl groups, and polymers having terminal or pendant ethylenic unsaturation. Examples of curable liquids suitable for the liquid developers of the present invention include, but are not limited to, acrylate and methacrylate monomers or polymers containing acrylic or methacrylic group(s) of the general structure

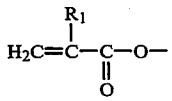

wherein $R_1$ is H or $CH_3$. The active group can be attached to an aliphatic or aromatic group with from 1 to about 20 carbon atoms and preferably from about 8 to about 12 carbon atoms, to an aliphatic or aromatic siloxane chain or ring with from 1 to about 20 dimethyl siloxane units, to a combination of the aforementioned groups, or to a polymer chain. Examples of such compounds include n-dodecyl acrylate, n-lauryl acrylate, methacryloxypropylpenta-methyldisiloxane, methyl-bis(trimethylsioxy)-silylpropylgylcerolmethacrylate, bis(methacryloxybutyl)tetramethyldisiloxane, 2-phenoxyethyl acrylate, polyethylene glycol diacrylate, ethyoxylated bisphenol A diacrylate, pentaerythritol triacrylate, poly(acryloxypropylmethyl)siloxane, methacrylate terminated polystyrene, polybutyldiene diacrylate, and the like. Further examples of liquids believed to be suitable liquid vehicles for the developers of the present invention include acrylic and methacrylic esters of polyhydric alcohols such as trimethylolpropane, pentaerythritol, and the like, and acrylate or methacrylate terminated epoxy resins, acrylate or methacrylate terminated polyesters, and the like. Another polymerizable material is the reaction product of epoxidized soy bean oil and acrylic or methacrylic acid as described in U.S. Pat. No. 4,215,167, the disclosure of which is totally incorporated herein by reference, as well as the urethane and amine derivatives described therein. Additional examples of radiation curable substances include acrylate prepolymers derived from the partial reaction of pentaerythritol with acrylic acid or acrylic acid esters, including those available from Richardson Company, Melrose Park, Ill. Further, isocyanate modified acrylate, methacrylate and itaconic acid esters of polyhydric alcohols as disclosed in U.S. Pat. Nos. 3,783,151, 3,759,809, and 3,825,479 are believed to be suitable. Radiation curable compositions based on these isocyanate modified esters including reactive diluents such as tetraethylene glycol diacrylate as well as photoinitiators such as chlorinated resins, chlorinated paraffins, and amine photoinitiation synergists are commercially available from Sun Chemical Corporation under the trade name of Suncure. Also believed to be suitable are mixtures of pentaerythritol acrylate and halogenated aromatic, alicyclic, or aliphatic photoinitiators as described in U.S. Pat. No. 3,661,614, the disclosure of which is totally incorporated herein by reference, as well as other halogenated resins that can be crosslinked by ultraviolet radiation. Additionally, materials believed to be suitable are disclosed in U.S. Pat. No. 4,399,209, the disclosure of which is totally incorporated herein by reference.

Also suitable are epoxy monomers or epoxy containing polymers having one or a plurality of epoxy functional groups, such as those resins which result from the reaction of bisphenol A (4,4'-isopropylidenediphenol) and epichlorohydrin, or by the reaction of low molecular weight phenolformaldehyde resins (Novolak resins) with epichlorohydrin, alone or in combination with an epoxy containing compound as a reactive diluent. Reactive diluents such as phenyl glycidyl ether, 4-vinylcyclohexene dioxide, limonene dioxide, 1,2-cyclohexane oxide, glycidyl acrylate, glycidyl methacrylate, styrene oxide, allyl glycidyl ether, and the like may be used as viscosity modifying agents. In addition, the range of these compounds can be extended to include polymeric materials containing terminal or pendant epoxy groups. Examples of these compounds are vinyl copolymers containing glycidyl acrylate or methacrylate as one of the comonomers. Other classes of epoxy containing polymers amenable to cure using the above cayalysts are epoxy-siloxane resins, epoxy-polyurethanes, and epoxy-polyesters. Further examples of suitable epoxy resins are described in *Encyclopedia of Polymer Science and Technology,* 2nd edition, Wiley Interscience, New York, pages 322 to 382 (1986) and in *Methoden Der Organischen Chemie,* Vol. E20 part 3, Georg Thiame Verlag Stuttgart, New York, pages 1891 to 1994 (1987), the disclosures of each of which are totally incorporated herein by reference.

Further examples of suitable curable materials include vinyl ether monomers, oligomers, or polymers containing vinyl ether groups of the general formula $$CHR_1{=}CR_2{-}O{-}$$

where $R_1$ and $R_2$ are hydrogen or alkyl groups with from 1 to about 10 carbon atoms, and preferably from 1 to 2 carbon atoms. Examples of such materials include decyl vinyl ether, dodecyl vinyl ether, hexadecyl vinyl ether, 4-chlorobutylvinyl ether, cyclohexyl vinyl ether, 1,4-cyclohexane dimethanol divinyl ether, diethylene glycol divinyl ether, butanediol divinyl ether, hexanediol divinyl ether, octanediol divinyl ether, decanediol divinyl ether. Further examples of vinyl ether monomers and polymers are shown in "Synthesis, Characterization, and Properties of Novel Aromatic Bispropenyl Ether" by J. V. Crivello and D. A. ConIon, *Journal of Polymer Science: Polymer Chemistry Edition*, Vol. 22, 2105–2121 (1984), "Aromatic Bisvinyl Ethers: A New Class of Highly Reactive Thermosetting Monomers" by J. V. Crivello and D. A. Conion, *Journal of Polymer Science: Polymer Chemistry Edition*, Vol. 21, 1785–1799 (1983), "Vinyloxy-Functional Organopolysiloxane Compositions," by J. V. Crivello and R. P. Eckberg, U.S. Pat. No. 4,617,238, "Carbocationic Polymerization of Vinyl Ethers" by T. Higashimura, M. Sawamoto in *Comprehensive Polymer Science*, Vol. (3), pages 673 to 696 (1989), "Polymerisation von Vinylethern" by J. Reiners in *Methoden Der Orcjanischen Chemie*, Vol. E20 part 2, Georg Thiame Verlag Stuttgart, New York, pages 1071–1115 (1987), the disclosures of each of which are totally incorporated herein by reference. Cyclic vinyl ethers with the following basic structure

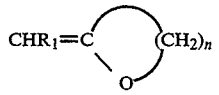

wherein $R_1$ is hydrogen or an alkyl group with from 1 to about 20 carbon atoms, and preferably from 1 to about 4 carbon atoms, and n=2 to about 20 and preferably from 3 to 8, are also useful, such as 4-phenyl-2-methylenetetrahydrofuran, 2-methylene-3,4-benzotetrahydrofuran, 2,2'-diphenyl-4-methylene- 1,3-dioxolane, 2-methyl-2-phenyl-4-methylene- 1,3-dioxolane and the like. Further examples can be found in "Ring-Opening Polymerization" by W. J. Bailey in *Comprehensive Polymer Science*, Vol. (3), pages 283 to 320 (1989), the disclosure of which is totally incorporated herein by reference.

Also suitable are styrene and indene monomers or oligomers, and polymers containing styrenic or indenic groups of the general formula

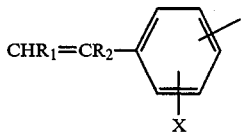

or

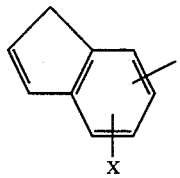

where $R_1$ and $R_2$ are H, alkyl, or aromatic groups, X is an electron donating group such as alkyl, alkoxy, N,N-dialkylamine groups and the like. The styrenic and indenic groups shown above can be attached to a polymer chain. Examples of such materials include butyl-styrene, p-ethoxy styrene, p-butoxy styrene, p-octoxy styrene, o-allyloxystyrene, divinyl benzene, 1,4-bis(p-vinylbenzeneoxy) butane, 1,8-bis(p-vinylbenzeneoxy)octane, and the like. Further examples of styrene and indene monomers are disclosed in *Vinyl and Related Polymers*, by C. E. Schildknecht, Wiley and Sons, 1952, chapters 1, 2, and 3, and *Cationic Polymerization of Olefins: A Critical Inventory*, by J. P. Kennedy, Wiley and Sons, 1975, pages 228–330, the disclosures of each of which are totally incorporated herein by reference.

In addition, vinyl acetal and ketene acetal monomers of the general formulae are suitable

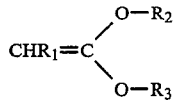

(I)

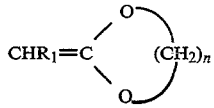

(II)

wherein $R_1$ is hydrogen or alkyl or aromatic groups with from 1 to about 20 carbon atoms, and preferably from 1 to about 6 carbon atoms, and R2 and $R_3$ are alkyl or aromatic groups with from 1 to about 20 carbon atoms, add preferably from 1 to about 6 carbon atoms, n=2 to 20 and preferably from 3 to 8 as in the case of cyclic vinyl acetal (II). Typical examples include diethyl ketene acetal, di-butyl ketene acetal, diphenyl ketene acetal, 2-methylene-l,3-dioxepane, 4-phenyl-2-methylene-1,3-dioxepane, 4,6-dimethyl-2-methylene-1,3-dioxane, 2-methylene-1,3-dioxe-5-pene, 4-vinyl-2-methylene-1,3-dioxzlane, and the like. Further examples are disclosed in "Ring-Opening Polymerization" by W. J. Bailey in *Comprehensive Polymer. Science*, Vol. 3, pages 283 to 320 (1989), the disclosure of which is totally incorporated herein by reference.

Further, linear or branched aliphatic α-olefins, such as 1-dodecene, 5-methyl-1-heptene, 2,5-dimethyl-1,5-hexadiene, and the like, alicyclic olefins and diolefins, such as d-limonene, 1,4dimethylenecyclohexane, 1-methylene-4-vinylcyclohexane, and the like, conjugated polyenes, such as 2-phenyl-1,3-butadiene, myrcene, allocimene, 1-vinylcyclohexene, ethylbenzofulvene, and the like, bicyclic olefins, such as α-pinene, β-pinene, 2-methylene-norbornane, and the like are all suitable carrier liquids. Further examples of these classes of olefins are disclosed in *Cationic Polymerization of Olefins: A Critical Inventory*, by J. P. Kennedy, Wiley and Sons, pages 1 to 228 (1975), the disclosure of which is totally incorporated herein by reference.

Liquid 1,2-polybutadiene resins of the formula $$-[CH_2-CH-(CH=CH_2)]_n-$$

with a molecular weight between about 200 and about 3000, and preferably between about 200 and 1000, are also suitable. A thiol compound is generally present as the comonomers with the olefin monomers. Typical examples include trithiol trimethyiolethane tris(β-mercaptopropionate), tetrathiol pentaerythritol tetrakis(thiogylcolate), dimonene dimercaptane, and the like.

Other curable liquid materials include those that contain moieties such as cinnamic groups of the formula $$-\overset{O}{\overset{\|}{C}}-CH=CH-$$

fumaric or maleic groups of the formula

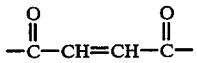

or maleimido groups of the formula

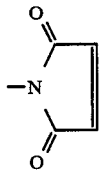

These functional groups can be present within either a monomer or a polymer comprising the liquid.

Specific examples include citrial, cinnamyl acetate, cinnamaldehyde, 4-vinylphenyl cinnamates, 4-vinylphenyl, -nitrocinnamate, 4-isopropenylphenyl cinnamate, poly[1-(cinnamoyloxymethylphenyl)ethylene], poly{1-(cinnamoyloxymethylphenyl)ethylene-co-1-[(4-nitrophenoxy)methylphenyl]ethylene}, 3-(2-furyl)acrolein), fumaric acid diethylester, fumaric acid dihexyl ester, maleic acid dibutylester, maleic acid diphenyl ester, N-phenyl maleinide, N-(4-butylphenyl) maleimide, m-phenylenediamine bis(maleimide), and N,N'-1,3 phenylenedimaleimide, and polyfunctional maleimide polymer MP-2000 from Kennedy and Klim, Little Silver, N.J.

In addition, monomers, dimers, or oligomers containing a multiplicity of one or more suitable functional groups can also be employed as the curable liquid.

Optionally, the curable liquid can contain a crosslinking agent. Crosslinking agents generally are monomers, dimers, or oligomers containing a multiplicity of functional groups, such as two styrene functionalities, a styrene functionality and an acrylate functionality, or the like. The curable liquid can consist entirely of these multifunctional monomers, dimers, or oligomers, can contain no crosslinking agent at all, and can contain both monofunctional monomers, dimers, or oligomers and multifunctional monomers or oligomers. Generally, the presence of a crosslinking agent is preferred to provide improved film forming characteristics, faster curing, and improved adhesion of the cured image to the substrate. When present, the crosslinking agent is present in an effective amount, typically from about 1 to about 100 percent by weight of the curable liquid and preferably from about 10 to about 50 percent by weight of the curable liquid.

The liquid developers of the present invention can also contain an initiator to initiate curing of the liquid vehicle. The initiator can be added before or after development of the image. Any suitable initiator can be employed provided that the objectives of the present invention are achieved; examples of the types of initiators suitable include thermal initiators, radiation sensitive initiators such as ultraviolet initiators, infrared initiators, visible light initiators, or the like, initiators sensitive to electron beam radiation, ion beam radiation, gamma radiation, or the like. In addition, combinations of initiators from one or more class of initiators can be employed. Radical photoinitiators and radical thermal initiators are well known, as is electron beam curing; these materials and processes are disclosed in, for example, "Radiation Curing of Coatings," G. A. Senich and R. E. Florin, *Journal of Macromolecular Science Review. Macromol. Chem. Phys.*, C24(2), 239–324 (1984), the disclosure of which is totally incorporated herein by reference. Examples of initiators include those that generate radicals by direct photofragmentation, including benzoin ethers such as benzoin isobutyl ether, benzoin isopropyl ether, benzoin methyl ether and the like, acetophenone derivatives such as 2,2-dimethoxy-2-phenylacetophenone, dimethoxyacetophenone, 4-(2-hydroxyethoxy)phenyl-(2-propyl)ketone, 2-hydroxy-2-methyl-1-phenylpropan-1-one, 2,2,2-trichloroacetophenone, 2,4,6-trimethylbenzoyldiphenylphospine oxide, and the like; initiators that form radicals by bimolecular hydrogen transfer, such as the photoexcited triplet state of diphenyl ketone or benzophenone, diphenoxybenzophenone, bis(N,N-dimethylphenyl) ketone or Michler's ketone, anthraquinone, 4-(2-acryloyl-oxyethyoxy)-phenyl-2-hydroxy-2-propylketone and other similar aromatic carbonyl compounds, and the like; initiators that form radicals by electron transfer or via a donor-acceptor complex, also known as an exciplex, such as methyldiethanolamine and other tertiary amines; photosensitizers used in combination with a radical generating initiator, wherein the sensitizer absorbs light energy and transfers it to the initiator, such as a combination of a thioxanthone sensitizer and a quinoline sulfonyl chloride initiator and similar combinations; cationic initiators that photolyze to strong Lewis acids, such as aryldiazonium salts of the general formula $Ar—N_2^+X^-$ wherein Ar is an aromatic ring such as butyl benzene, nitrobenzene, dinitrobenzene, or the like and X is $BF_4$, $PF_6$, $AsF_6$, $SbF_6$, $CF_3SO_3$, or the like, diaryliodonium salts of the general formula $Ar_2I^+X^-$, wherein Ar is an aromatic ring such as methoxy benzene, butyl benzene, butoxy benzene, octyl benzene, didecyl benzene, or the like, and X is an ion of low nucleophilicity, such as $PF_6$, $AsF_6$, $BF_4$, $SbF_6$, $CF_3SO_3$, and the like; triarylsulfonium salts of the general formula $Ar_3S^+X^-$, wherein Ar is an aromatic ring such as hydroxy benzene, methoxy benzene, butyl benzene, butoxy benzene, octyl benzene, dodecyl benzene, or the like and X is an ion of low nucleophilicity, such as $PF_6$, $AsF_6$, $SbF_6$, $BF_4$, $CF_3SO_3$, or the like; nonradical initiators comprising amine salts of alpha-oketocarboxylic acids, such as the tributyl ammonium salt of phenylglyoxylic acid; and the like, as well as mixtures thereof. Further photoacid generating initiators are disclosed in "The Chemistry of Photoacid Generating Compounds,"by J. V. Crivello in Proceedings of the *ACS Division of Polymeric Materials: Science and Engineering*, Vol. 61, pages 62–66, (1989), "Redox Cationic Polymerization: The Diaryliodonium Salt/Ascorbate Redox Couple," by J. V. Crivello and J. H. W. Lam in *Journal of Polymer Science: Polymer Chemistry Edition*, Vol. 19, pages 539–548 (1981), "Redox-lnduced Cationic Polymerization: The Diaryliodonium Salt/Benzoin Redox Couple," by J. V. Crivello and J. L. Lee in *Journal of Polymer Science: Polymer Chemistry Edition*, Vol. 21, pages 1097–1110 (1983), "Diaryliodonium Salts as Thermal Initiators of Cationic Polymerization," by J. V. Crivello, T. P. Lockhart and J. L. Lee in *Journal of Polymer Science: Polymer Chemistry Edition*, Vol. 21, pages 97–109 (1983), the disclosures of each of which are totally incorporated herein by reference.

Further examples of suitable initiators include alpha-alkoxy phenyl ketones, O-acylated alpha-oximinoketones, polycyclic quinones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, alpha-halo alpha-phenylacetophenones, photoreducible dye-reducing agent redox couples, halogenated paraffins such as brominated or chlorinated paraffin, benzoin alkyl esters, cationic diborate anion complexes, anionic di-iodonium ion compounds, and anionic dye-pyrrilium compounds.

Additional examples of suitable initiators are disclosed in, for example, U.S. Pat. Nos. 4,683,317, 4,378,277, 4,279,717, 4,680,368, 4,443,495, 4,751,102, 4,334,970, "Complex Triarylsulfonium Salt Photoinitiators I. The Identification, Characterization, and Syntheses of a New Class of Triarylsulfonium Salt Photoinitiators," J. V. Crivello and J. H. W. Lam, *Journal of Polymer Science: Polymer Chemistry Edition*, Vol. 18, 2677–2695 (1980); "Complex Triarylsulfonium Photoinitiators II. The Preparation of Several New Complex Triarylsulfonium salts and the Influence of Their Structure in Photoinitiated Cationic Polymerization," J. V. Crivello and J. H. W. Lam, *Journal of Polymer Science Polymer Chemsitry Edition*, Vol. 18, pages 2697–2714 (1980); "Diaryliodonium Salts A New Class of Photoinitiators for Cationic Polymerization,"J. V. Crivello and J. H. W. Lam, *Maromolecules*, Vol. 10, pages 1307–1315 (1977); and "Developments in the Design and Applications of Novel Thermal and Photochemical Initiators for Cationic Polymerization" by J. V. Crivello, J. L. Lee and D. A. Conlon in *Makromol. Chem. Macromolecular Symposium*, Vol. 13/14, pages 134–160 (1988), the disclosures of each of which are totally incorporated herein by reference. Particularly preferred are the diaryl iodonium salts and their derivatives, the triaryl sulfonium salts and their derivatives, and the triphenyl phosphonium salts and their derivatives, with examples of derivatives being those with alkyl, aryl, or alkoxy substituents on the aryl rings. The initiator is present in the curable liquid in an effective amount, generally from about 0.1 to about 10 percent by weight of the liquid, and preferably from about 0.1 to about 3 percent by weight of the liquid.

In one embodiment of the present invention, the liquid developers of the present invention contain a heterogeneous initiator contained in or on the surfaces of solid particles in the developer to initiate curing of the liquid vehicle. Any initiator substantially insoluble in the curable liquid vehicle and capable of curing the liquid vehicle can be employed. "Substantially insoluble" in this context means any initiator that when mixed with the liquid vehicle dissolves to an extent of less than 1 part by weight initiator per 100 parts by weight liquid vehicle (less than 1 percent solubility), and preferably dissolves to an extent of 1 part by weight initiator or less per 1,000 parts by weight liquid vehicle (0.1 percent solubility or less).

In this embodiment, the initiators are contained either within or on the surfaces of solid particles present in the liquid developers of the present invention. These particles are particulate materials substantially insoluble in the liquid vehicle. Preferably, the particles are less than 50 microns in average diameter, more preferably less than 10 microns in average diameter, and most preferably less than 1 micron in average diameter. In one embodiment of the present invention, the heterogeneous initiator is contained on the surfaces of pigment particles employed as a colorant in the developer. In another embodiment, the heterogeneous initiator is contained on the surfaces of polymeric particles insoluble in the liquid vehicle and present in the developer for any purpose, such as to enhance fix of the developed image to a substrate, or the like. In yet another embodiment, the liquid developer contains toner particles comprising a polymer and a pigment, and the heterogeneous initiator is present on the surfaces of the toner particles. In still another embodiment of the present invention, the particles are present in the developer solely for the purpose of acting as carriers for the heterogeneous initiator. Examples of such particles include silicas, such as fumed, precipitated, and natural silicas, diatomaceous earth, clays, such as bentonite, kaolinite, and attapulgus clays, metal oxides, carbonates, and sulfates, such as those of titanium, antimony, iron, nickel, zinc, tin, copper, or the like as well as mixtures thereof, alumina, glass, starch, including cornstarch, comminuted cellulose, such as cotton or wood, carbon blacks, graphites, diamond, polymers, latexes, such as those of polystyrene, polyvinyltoluene, polyvinylpyrrolidone, polyacrylic acid, polyacrylates, polymethacrylates, or the like, pigment particles, or any other suitable particles of the desired size capable of containing the initiator on their surfaces or within the particle material.

In addition, it is possible for the initiator to be solid in form and for the particles to consist solely of the initiator material provided that the particles can be broken down into particles of the appropriate size or prepared initially in the form of particles of the appropriate size.

In this embodiment, the initiator is present in the liquid developers of the present invention in any effective amount, typically from about 0.005 to about 5 percent by weight, and preferably from about 0.2 to about 2 percent by weight. In addition, the initiator is present within or on the surfaces of the solid particles in any effective amount, typically from about 0.05 to about 100 percent by weight of the solid particles, and preferably from about 5 to about 50 percent by weight of the solid particles. The total amount in the liquid developers of the present invention of solid particles containing an initiator can be any effective amount, typically from about 0.05 to about 5 percent by weight, and preferably from about 0.2 to about 2 percent by weight.

The initiator can be applied to the solid particles by any suitable method, such as by dissolving the initiator in a solvent, dispersing the solid particles in the solution, agitating the dispersion, and subsequently evaporating the solvent to obtain dry solid particles having the initiator on the particle surfaces, or by milling the solid particles and the initiator together, followed by adding other liquid developer ingredients and milling further to obtain a developer, or the like.

When a photoinitiator is selected, photopolymerization can be performed with the aid of an autoxidizer, which is generally a compound capable of consuming oxygen in a free radical chain process. Examples of useful autoxidizers include N,N-dialkylaninines, particularly those substituted in one or more of the ortho, meta, or para positions with groups such as methyl, ethyl, isopropyl, t-butyl, 3,4-tetramethylene, phenyl, trifluoromethyl, acetyl, ethoxycarbonyl, carboxy, carboxylate, trimethylsilylmethyl, trimethylsilyl, triethylsilyl, trimethylgermanyl, triethylgermanyl, trimethylstannyl, triethylstannyl, n-butoxy, n-pentyloxy, phenoxy, hydroxy, acetyl-oxy, methylthio, ethylthio, isopropylthio, thio-(mercapto-), acetylthio, fluoro, chloro, bromo, or iodo. Autoxidizers when present are present in an effective amount, typically from about 0. 1 to about 5 percent by weight, of the curable liquid.

A UV sensitizer which could impart electron transfer, and exciplex-induced bond cleavage processes during radiation curing can, if desired, be included in the liquid developers of the present invention. Typical photosensitizers include anthrecene, perylene, phenothiazine, thioxanthone, benzophenone, fluorenone, and the like. The sensitizer is present in an effective amount, typically from about 0.1 to about 5 pecent by weight, of the curable liquid. If desired, the UV sensitizer can be insoluble in the liquid vehicle and can be present on or in the solid particles containing the initiator.

The liquid developers of the present invention can also include a charge control agent to help impart a charge to the colored toner particles. A charge control additive is generally present in the electrophoretic liquid developers and the photoelectrophoretic liquid developers of the present invention to impart to the particles contained in the liquid a charge sufficient to enable them to migrate through the liquid vehicle to develop an image. Examples of suitable charge control agents for liquid developers include the lithium, cadmium, calcium, manganese, magnesium and zinc salts of heptanoic acid; the barium, aluminum, cobalt, manganese, zinc, cerium and zirconium salts of 2-ethyl hexanoic acid, (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum resinate, aluminum salt of 3,5 di-t-butyl gamma resorcylic acid. Mixtures of these materials may also be used. Particularly preferred charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; salts of barium, aluminum, cobalt, manganese, zinc, cerium, and zirconium octoates; salts of barium, aluminum, zinc, copper, lead, and iron with stearic acid; iron naphthenate; and the like, as well as mixtures thereof. The charge control additive may be present in an amount of from about 0.001 to about 3 percent by weight, and preferably from about 0.01 to about 0.8 percent by weight of the developer composition. Other additives, such as charge adjuvants added to improve charging characteristics of the developer, may be added to the developers of the present invention, provided that the objectives of the present invention are achieved. Charge adjuvants such as stearates, metallic soap additives, polybutylene succinimides, and the like are described in references such as U.S. Pat. Nos. 4,707,429, 4,702,984, and 4,702,985, the disclosures of each of which are totally incorporated herein by reference.

Generally, the liquid component of the liquid developers of the present invention is present in a large amount, and constitutes that percentage by weight of the developer not accounted for by the solid components. The liquid vehicle is usually present in an amount of from about 80 to about 99 percent by weight, although the amount may vary from this range provided that the objectives of the present invention are achieved.

The liquid developers of the present invention can contain any kind of colored toner particle typically used in conventional liquid developers and compatible with the liquid vehicle. For example, the toner particles can consist solely of pigment particles dispersed in the liquid vehicle. Since the liquid vehicle is cured to a solid before, or after transfer, the pigment particles can become affixed to the print substrate by the cured liquid vehicle, and no additional polymeric component is required in the developer for fixing purposes. If desired, however, a polymeric component can be present in the developer. The polymer can be soluble in the liquid vehicle, and can include polymers such as poly(2-ethyl hexylmethacrylate); poly(isobutylene-co-isoprenes), such as Kalene 800, available from Hardman Company, N.J.; polyvinyl toluene-based copolymers, including vinyl toluene acrylic copolymers such as Pliolite OMS, Pliolite AC, Pliolite AC-L, Pliolite FSA, Pliolite FSB, Pliolite FSD, Pliolite FSE, Pliolite VT, Pliolite VT-L, Pliolite VTAC, and Pliolite VTAC-L, available from the Goodyear Tire and Rubber Company, Neocryl S-1002 and EX519, available from Polyvinyl Chemistry Industries, Parapol 900, Parapol 1300, and Parapol 2200, available from Exxon Company, and the like; block copolymers such as poly(styrene-b-hydrogenated butadiene), including Kraton G 1701, available from Shell Chemical Company; and the like, as well as mixtures thereof, as disclosed in, for example, copending U.S. application Ser. No. 07/369,003, the disclosure of which is totally incorporated herein by reference. In addition, the polymer can be insoluble in the liquid vehicle, and can be present either as separate particles or as an encapsulating shell around the pigment particles. Examples of suitable polymers in this instance include ethylene-vinyl acetate copolymers such as the Elvax® I resins available from E.I. Du Pont de Nemours & Company, copolymers of ethylene and an $\alpha,\beta$-ethylenically unsaturated acid selected from acrylic or methacrylic acid, where the acid moiety is present in an amount of from 0.1 to 20 percent by weight, such as the Nucrel® II resins available from E.I. Du Pont de Nemours & Company, polybutyl terephthalates, ethylene ethyl acrylate copolymers such as those available as Bakelite DPD 6169, DPDA 6182 Natural, and DTDA 9169 Natural from Union Carbide Company, ethylene vinyl acetate resins such as DQDA 6479 Natural 7 and DQDA 6832 Natural 7 avalable from Union Carbide Company, methacrylate resins such as polybutyl methacrylate, polyethyl methacrylate, and polymethyl methacrylate, available under the trade name Elvacite from E.I. Du Pont de Nemours & Company, and others as disclosed in, for example, British Patent 2,169,416 and U.S. Pat. No. 4,794,651, the disclosures of which are totally incorporated herein by reference. Further, the polymer can be partially soluble in the liquid vehicle, or soluble in the vehicle at elevated temperatures of, for example, over 75° C. and insoluble at ambient temperatures of, for example, from about 10° C. to about 65° C. Examples of suitable polymers in this instance include polyolefins and halogenated polyolefins, such as chlorinated polypropylenes and poly-$\alpha$-olefins, including polyhexadecenes, polyoctadecenes, and the like, as disclosed in copending U.S. application Ser. No. 07/300,395, the disclosure of which is totally incorporated herein by reference.

Suitable pigment materials include carbon blacks such as Microlith® CT, available from BASF, Printex® 140 V, available from Degussa, Raven® 5250 and Raven® 5720, available from Columbian Chemicals Company, and Mogul-L, Black Pearls L, and the Regal carbon blacks from Cabot Corporation. Pigment materials may be colored, and may include magenta pigments such as Hostaperm Pink E (Hoechst Celanese Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it either combines well with any polymeric material also included in the developer composition or is suitable in itself as a toner particle in that it is of the desired particle size and, in the electrophoretic and photoelectrophoretic embodiments of the present invention, is capable of becoming charged and migrating through the liquid vehicle to develop an image. The pigment particles are present in an amount sufficient to enable development of a colored image, typically from about 5 to about 100 percent by weight of the solids content of the developers of the present invention. Polymeric components of the solids portion of the developers, when present, are present in any amount up to about 95 percent by weight of the solids component of the liquid developers of the instant invention.

Examples of photosensitive pigments suitable for use in the photoelectrophoretic liquid developers of the present invention are disclosed in, for example, U.S. Pat. No. 3,384,488, the disclosure of which is totally incorporated herein by reference. This patent also discloses additional materials, such as charge transfer materials, that can be contained in the photoelectrophoretic liquid developers of the present invention.

In all instances wherein a pigment is a component of the liquid developer, the pigment can be a "flushed" pigment. Flushed pigments generally are those pigments that are sold in a form readily suitable for dispersion into organic media. Pigments often are manufactured by an aqueous precipitation reaction, and the product is collected in a water-wet pigment cake by filtration. The cake is then dried to obtain a dry pigment powder. Flushed pigments, however, are not dried to powder; instead, the filter cake is mixed with an organic solvent such as mineral oils, litho oils, or gloss ink varnishes, until a phase transfer occurs in which the pigment spontaneously transfers from the aqueous phase to the organic phase as a result of stirring. Employing flushed pigments for the developers of the present invention results in advantages such as a reduced need for mixing and processing of the liquid developer during formulation to obtain desirable pigment particle sizes, since the particles are already small in the organic dispersion. In addition, the organic pigment dispersion can be mixed readily with a variety of vehicles. Particularly preferred for the present invention are flushed pigments in curable liquid media, such as alkyds, polyesters, or the like. A liquid developer of the present invention can be prepared from flushed pigments by simple mixing of the flushed pigment with the liquid vehicle and the other developer ingredients. Examples of flushed pigments suitable for the present invention include Alkyd Based, Sunset II, Quantum Set II, Polyversyl, and Valuset II flushes from Sun Chemical Corporation, and the like. Further information regarding flushed pigments is disclosed in, for example, U.S. Pat. No 4,794,066, the disclosure of which is totally incorporated herein by reference.

In addition, the liquid developers of the present invention can contain toner particles comprising dyed silica particles as disclosed in copending U.S. application Ser. No. 07/369,003, the disclosure of which is totally incorporated herein by reference.

Additional references disclosing suitable toner particles include U.S. Pat. Nos. 4,794,651, 4,762,764, 3,729,419, 3,841,893, and 3,968,044, the disclosures of each of which are totally incorporated herein by reference.

In embodiments of the present invention such as liquid developers and processes employing polarizable liquid development, the developer can contain a dye instead of pigment particles. Further, in embodiments of the present invention wherein colored particles migrate through the liquid medium to form images, the particles can be colored with a dye instead of with a pigment. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R, available from Aldrich, Neolan Blue, available from Ciba-Geigy, Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present provided that the objectives of the present invention are achieved.

The liquid developers of the present invention can also contain various polymers added to modify the viscosity of the developer or to modify the mechanical properties of the developed or cured image such as adhesion or cohesion. In particular, when the liquid developer of the present invention is intended for use in polarizable liquid development processes, the developer can also include viscosity controlling agents. Examples of suitable viscosity controlling agents include thickeners such as alkylated polyvinyl pyrrolidones, such as Ganex V216, available from GAF; polyisobutylenes such as Vistanex, available from Exxon Corporation, Kalene 800, available from Hardman Company, New Jersey, ECA 4600, available from Paramins, Ontario, and the like; Kraton G-1701, a block copolymer of polystyrene-b-hydrogenated butadiene available from Shell Chemical Company, Polypale Ester 10, a glycol rosin ester available from Hercules Powder Company; and other similar thickeners. In addition, additives such as pigments, including silica pigments such as Aerosil 200, Aerosil 300, and the like available from Degussa, Bentone 500, a treated montmorillonite clay available from NL Products, and the like can be included to achieve the desired developer viscosity. Additives are present in any effective amount, typically from about 1 to about 40 percent by weight in the case of thickeners and from about 0.5 to about 5 percent by weight in the case of pigments and other particulate additives.

In addition, liquid developers of the present invention intended for use in polarizable liquid development processes can also contain conductivity enhancing agents. For example, the developers can contain additives such as quaternary ammonium compounds as disclosed in, for example, U.S. Pat. No. 4,059,444, the disclosure of which is totally incorporated herein by reference.

In one specific embodiment of the present invention, the liquid developers can contain a small amount of a release agent. Images prepared with the developers of the present invention can be cured before or after transfer of the image to a printing substrate. In addition, the images can be partially cured prior to transfer, followed by additional curing subsequent to transfer. When the image is cured prior to transfer, it is desirable for the image to be released easily from the imaging member and also to adhere to the substrate, such as paper, transparency material, or the like. By including a small amount of release agent in the developer, transfer from the imaging member is enhanced. Examples of suitable release agents include noncurable liquids typically employed as liquid vehicles for liquid developers, such as high purity aliphatic hydrocarbons with, for example, from about 7 to about 25 carbon atoms and preferably with a viscosity of less than 2 centipoise, such as Norpar ®12, Norpar ®13, and Norpar ®15, available from Exxon Corporation, isoparaffinic hydrocarbons such as Isopar ®G, H, K, L, M, and V, available from Exxon Corporation, Amsco ®460 Solvent, Amsco ®OMS, available from American Mineral Spirits Company, Soltrol ®, available from Phillips Petroleum Company, Pagasol ®, available from Mobil Oil Corporation, Shellsol ®, available from Shell Oil Company, and the like, as well as mixtures thereof. The release agent can be present in any amount of up to about 20 percent by weight of the liquid. Curing or partial curing of an image developed with a developer containing a noncurable release agent results in a coherent image that is readily released from the smooth imaging member but that still adheres readily to the substrate, particularly porous substrates such as paper or fabric. The non-curing portion of the liquid is then absorbed into the substrate, particularly when this portion is a high molecular weight hydrocarbon, such as Magiesol 60 or Isopar ®V, or a silicone oil. The release agent functionality may also be obtained by using siloxane or fluorocarbon containing components in the curable vehicle. The liquid vehicle can either contain a siloxane or fluorocarbon release agent as an additive, or, if the selected siloxane or fluorocarbon release agent is of suitable viscosity and resisitivity, the liquid vehicle can contain a major portion (up to 100 percent) of the siloxane or fluorocarbon release agent. Examples of siloxane materials include polydimethylsiloxanes terminated with 4-vinylcyclohexene oxide, such as the UV9300 and UV9305 silicone epoxy polymers from GE.

The liquid developers of the present invention generally can be prepared by any method suitable for the type of toner particles selected. For example, when the toner ingredients comprise a polymer and a pigment, the developer can be prepared by mixing the ingredients, followed by grinding the mixture in an attritor in the presence of the selected liquid vehicle. When the toner ingredients comprise colored silica particles, the developer can be prepared by heating and mixing the ingredients, followed by grinding the mixture in an attritor until homogeneity of the mixture has been achieved. Colored silica particles can be prepared by the processes described in, for example, U.S. Pat. Nos. 4,566,908, 4,576,888, 4,877,451, and copending U.S. application Ser. No. 07/369,003, the disclosures of each of which are totally incorporated herein by reference. When the solids content of the developer contains pigment particles and a polymer soluble in the liquid vehicle at elevated temperatures and insoluble at ambient temperatures, the polymer can be dispersed by heating the mixture, grinding the mixture in an attritor at elevated temperatures, and grinding while the mixture cools. Methods of preparing various kinds of liquid developers are disclosed in several of the documents previously incorporated herein by reference, including U.S. Pat. Nos. 4,476,210, 4,794,651, 4,877,698, 4,880,720, 4,880,432, and copending U.S. application Ser. Nos. 07/369,003 and 07/300,395. The charge control agent can be added to the mixture either during mixing of the other ingredients or after the developer has been prepared. Similarly, the initiator that enables curing of the liquid vehicle can either be added with the other developer ingredients or at a later time, including immediately before use of the developer. When the initiator is insoluble in the liquid vehicle and is contained in or on solid particles, the solid particles containing the initiator that enables curing of the liquid vehicle can either be added with the other developer ingredients or at a later time, including immediately before use of the developer. Further, in another embodiment of the present invention, the liquid developer contains little or no initiator during the development step, and the initiator is added to the developed image. This can be accomplished in any suitable manner, such as by spraying the developed image with the initiator, by incorporating the initiator into the substrate on which the final image will be contained, by applying the initiator as an undercoat or an overcoat, or the like. Additionally, the liquid developer can contain little or no crosslinking agent during the development step, and the crosslinking agent can be added to the developed image in any suitable manner.

In general, images are developed with the liquid electrophoretic developers and the polarizable liquid developers of the present invention by generating an electrostatic latent image and contacting the latent image with the liquid developer, thereby causing the image to be developed. When a liquid electrophoretic developer of the present invention is employed, the process entails generating an electrostatic latent image and contacting the latent image with the developer comprising a liquid vehicle and charged toner particles, thereby causing the charged particles to migrate through the liquid and develop the image. Developers and processes of this type are disclosed in, for example, U.S. Pat. Nos. 4,804,601, 4,476,210, 2,877,133 2,890,174, 2,899,335, 2,892,709, 2,913,353, 3,729,419, 3,841,893, 3,968,044, 4,794,651, 4,762,764, 4,830,945, 3,976,808, 4,877,698, 4,880,720, 4,880,432, and copending application U.S. Ser. No. 07/300,395, the disclosures of each of which are totally incorporated herein by reference. When a liquid developer of the present invention suitable for polarizable liquid development processes is employed, the process entails generating an electrostatic latent image on an imaging member, applying the liquid developer to an applicator, and bringing the applicator into sufficient proximity with the latent image to cause the image to attract the developer onto the imaging member, thereby developing the image. Developers and processes of this type are disclosed in, for example, U.S. Pat. Nos. 4,047,943, 4,059,444, 4,822,710, 4,804,601, 4,766,049, 4,686,936, 4,764,446, Canadian Patent 937,823, Canadian Patent 926,182, Canadian Patent 942,554, British Patent 1,321,286, and British Patent 1,312,844, the disclosures of each of which are totally incorporated herein by reference. In both of these embodiments, any suitable means can be employed to generate the image. For example, a photosensitive imaging member can be exposed by incident light or by laser to generate a latent image on the member, followed by development of the image and transfer to a substrate such as paper, transparency material, cloth, or the like.

In addition, an image can be generated on a dielectric imaging member by electrographic or ionographic processes as disclosed, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, 4,485,982, 4,731,622, 3,701,464, and 4,155,093, the disclosures of each of which are totally incorporated herein by reference, followed by development of the image and, if desired, transfer to a substrate. If necessary, transferred images can be fused to the substrate by any suitable means, such as by heat, pressure, exposure to solvent vapor or to sensitizing radiation such as ultraviolet light or the like as well as combinations thereof. Further, the liquid developers of the present invention can be employed to develop electrographic images wherein an electrostatic image is generated directly onto a substrate by electrographic or ionographic processes and then developed, with no subsequent transfer of the developed image to an additional substrate.

The photoelectrophoretic liquid developers of the present invention can be employed in photoelectrophoretic development processes, which generally entail placing a suspension of electrically photosensitive particles in a fluid between two electrodes, at least one of which is generally a substantially transparent plate. Exposure of the suspension to a light image while a field is applied between the electrodes causes the formation of an image by deposition of the suspended particles in imagewise configuration on the electrode. In one embodiment, as disclosed, for example, in U.S. Pat. No. 4,043,655, both electrodes are transparent plates. In another embodiment, as disclosed, for example, in U.S. Pat. No. 4,023,968, one electrode is a transparent conductive support and the other is a generally cylindrically shaped biased electrode that is rolled across the first electrode upon which has been placed the suspension of photosensitive particles. Multicolor images can be made by, among other methods, employing a developer containing photosensitive particles of all desired colors and sequentially exposing the suspension to light images through color filters. Photoelectrophoretic processes are described in detail in, for example, U.S. Pat. Nos. 4,043,655, 4,023,968, 4,066,452, 3,383,993, 3,384,566, 3,384,565, and 3,384,488, the disclosures of each of which are totally incorporated herein by reference. Photoelectrophoretic liquid developers of the present invention can be prepared by preparing any of the liquid photoelectrophoretic developers disclosed in these patents with the exception that the liquid vehicle is replaced with a curable liquid so that the resulting developer has the desired resistivity and viscosity characteristics.

Subsequent to development of the image with the liquid developer of the present invention, the image is cured, causing residual liquid vehicle on the image to solidify. Curing can take place before transfer, or after transfer. In situations such as electrographic imaging wherein the image is developed directly on the substrate and no transfer occurs, the image is cured subsequent to development. When transfer to a substrate is desired, the developed image can be partially cured prior to transfer; partial curing can impart tacky surface characteristics to the developed image, which can enhance transfer to a substrate. In addition, curing subsequent to transfer can greatly enhance adhesion of the image to the substrate, since the liquid vehicle can penetrate the substrate, particularly when the substrate is porous such as cloth or paper, and curing results in the image being tightly bound to the fibers of the substrate. In addition, curing subsequent to transfer can greatly enhance adhesion to the substrate, whether the substrate is smooth or porous, when the substrate has reactive sites, either naturally occurring as in cellulose or clays, or added as a precoating, with which reactive species in the liquid developer can react.

Curing can be by any suitable means, and generally is determined at least in part by the nature of the initiator selected. When a photoinitiator is selected, curing is effected by exposure of the image to radiation in the wavelength to which the initiator is sensitive, such as ultraviolet light. Examples of suitable ultraviolet lamps include low pressure mercury lamps, medium pressure mercury lamps, high pressure mercury lamps, xenon lamps, mercury xenon lamps, arc lamps, gallium lamps, lasers, and the like. When a thermal initiator is selected, the image is heated to a temperature at which the initiator can initiate curing of the liquid vehicle and maintained at that temperature for a period sufficient: to cure the image. Electron beam curing can be initiated by any suitable electron beam apparatus. Examples include scanned beam apparatuses, in which electrons are generated nearly as a point source and the narrow beam is scanned electromagnetically over the desired area, such as those available from High Voltage Engineering Corporation, Radiation Dynamics, Inc. (a subsidiary of Monsanto Company), Polymer Physik of Germany, or the like, and linear-filament apparatuses or curtain processor apparatuses, in which electrons are emitted from a line-source filament and accelerated perpendicular to the filament in a continuous linear curtain, such as those available from Energy Sciences, Inc. under the trade name Electrocurtain. Ion beam curing can be initiated by any suitable means, such as a corotron.

The liquid developers of the present invention exhibit several advantages over liquid developers having noncurable liquid vehicles. For example, the copies or prints prepared with liquid developers having noncurable liquid vehicles frequently exhibit an objectionable odor caused by residual liquid vehicle remaining in the paper. Copies or prints prepared with liquid developers of the present invention, however, exhibit little or no odor, since any liquid vehicle remaining on the print substrate after transfer is cured to a solid state. In addition, copiers or printers employing liquid development processes frequently emit solvent vapors from the drying of the noncurable liquid vehicle of the developer. Costly and complex solvent capture systems are necessary to reduce solvent emissions of these solvents. Since the hydrocarbon liquid vehicles frequently employed in conventional liquid developers tend to be chemically unreactive, vapors from these hydrocarbons can be captured only by physical or mechanical means. In contrast, the curable liquid vehicles of the developers of the present invention are more chemically reactive than noncurable liquid hydrocarbons, and solvent emissions from copiers or printers employing these developers can be captured by simple, inexpensive chemical means such as by the presence of a catalyst that cures the liquid or by light exposure. In addition, waste disposal of used developer from copiers and printers employing conventional liquid developers constitutes an additional expense and inconvenience, since the liquid vehicle must be disposed of by acceptable organic solvent disposal procedures. The liquid developers of the present invention, however, can be cured to a solid, so that unused developer in the machine can be cured and disposed of as a solid. Additionally the major portion of the liquid in curable liquid developers will be carried out in the cured solid image. When non-curable liquid developers are used, the major portion of the liquid developer is collected as waste. Copies or prints prepared from liquid developers of the present invention also exhibit excellent fix to a substrate, particularly when the developed image is cured after it has been transferred to the substrate. The uncured liquid vehicle in the developed image penetrates the substrate, and subsequent curing results in the image becoming intimately bound to the paper or fabric fibers or to the substrate surface.

In addition, liquid developers of the present invention wherein the developer contains an initiator substantially insoluble in the liquid vehicle and contained on or in solid particles in the developer exhibit several advantages over curable liquid developers wherein the polymerization initiator is soluble in the liquid vehicle. For example, the choice of liquid vehicle is for a developer is broader when the suitable liquids are not restricted to those in which a polymerization initiator is soluble. Further, the liquid developers of the present invention require no solubilizing solvents to render the selected initiator soluble in the liquid vehicle. In addition, in some instances an initiator can be rendered soluble in a liquid vehicle by chemical derivatization of the initiator; the present invention, however, eliminates the need to derivatize an initiator to render it soluble in the liquid vehicle.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

An electrophoretic liquid developer curable by ultraviolet radiation was prepared by first preparing a concentrated developer as described generally by Trout in U.S. Pat. No. 4,707,429, column 11, Example 3, the disclosure of which is totally incorporated herein by reference, and then diluting the concentrate with UV curable monomers. Specifically, 35 parts by weight of Nucrel 699, a copolymer of ethylene (91 percent) and methacrylic acid (9 percent) with a Melt Index at 190° C. of 100 and an Acid Number of 60, available from E.I. Du Pont de Nemours & Company, Wilmington, Del., 0.75 parts by weight of aluminum tristearate (a charge adjuvant), available from Mathe Chemical Corporation, Lodi, N.J., 2.45 parts by weight of Sterling NS N774 carbon black, available from Cabot Corporation, Boston, Mass., and 125 parts by weight of Isopar® L, available from Exxon Corporation, were charged to a Union Process Attritor, Union Process Company, Akron, Ohio. The ingredients were heated to 90° C.±10° C. and milled at a rotor speed of 230 rpm with 0.1875 inch (4.76 mm) diameter stainless steel balls. The average particle size by area was monitored during milling with a Horiba CAPA-500 centrifugal particle analyzer (the particle sizing procedure is described in U.S. Pat. No. 4,707,429, column 4, lines 60 to 67). When the average particle size was less than 10 microns, the ingredients were cooled to room temperature while milling was continued. The steel balls were removed after the mixture had reached room temperature. Basic Barium Petronate, an oil-soluble petroleum sulfonate, available from Sonneborn Division of Witco Chemical Corporation, New York, N.Y., was then added (96 milligrams per gram of solids) to the mixture as a charge director. Subsequently, the concentrate mixture prepared according to the process of U.S. Pat. No. 4,707,429 was diluted to 2% by weight solids with a one-to-one mixture by weight of decyl vinyl ether (Decave, available from International Flavors & Fragrances, Inc., New York, N.Y.) and 1,4,-bis[(vinyloxy)methyl)]-cyclohexane (Rapi-Cure CHVE, available from GAF Corporation, Wayne, N.J). The resistivity of the developer was measured (at 5 volts, 5 hertz) as $4.3\times10^{10}$ ohm-cm. The Isopar® L from the concentrate remained in the liquid developer as a release agent.

Thereafter, an electrostatic image was created on a sheet of dielectric coated paper (Versatec® 4011 electrographic paper, available from Versatec, Santa Clara, Calif.) by (1) lightly gluing a 4 inch by 5 inch piece of the dielectric paper, coated side out, to a 4 inch by 5 inch by 0.5 inch aluminum block; (2) grounding the aluminum plate to a high voltage power supply, model 206 Pacific Precision Instruments, Concord, Calif.; (3) setting the power supply to +500 volts and attaching the power supply lead to a bundle of resistive carbon fibers, Celion Celect 675, Celanese, Chatam, N.J. held in a thin plastic tube; and (4) writing an image on the dielectric paper with the charged fiber bundle used as a pencil.

The electrostatic image was developed into a visible image by (1 ) mounting the aluminum plate with the attached imagewise charged dielectric paper over a second aluminum plate so that the gap between the plates was 1 millimeter; (2) attaching the power supply ground to the image-holding plate and attaching the power supply lead with +100 volt potential applied to the opposite aluminum electrode (this electrical bias suppresses background development on the charged dielectric paper); (3) pouring approximately 5 milliliters of the electrophoretic liquid developer between the two plates allowing the excess to drain out; and (4) separating the aluminum plates. A dark image with little background development corresponding to the written image was clearly visible.

The developed image was cured by (1) making a 0.67 percent by weight solution of bis(tert-butylphenyl)iodinum hexafluoroarsenate prepared by the method described by Crivello and Lam, *Macromolecules,* 10(6) 1307 (1977), the disclosure of which is totally incorporated herein by reference, in a 2 to 1 mixture of decyl vinyl ether (Decave) and 1,4,bis[(vinyloxy)methyl)]-cyclohexane (Rapi-Cure CHVE) and heating the solution to 90° C. for 15 minutes; (2) spraying this initiator solution over the toned image with a Crown Spra-tool, Crown Industrial Products Company, Hebron, Ill.; and (3) passing the oversprayed toned image through a Hanovia UV-6 cure station, Hanovia, Newark, N.J., with the UV lamp set to 300 watts and the conveyor traveling at 20 feet per minute. The image was dry to the touch after curing and withstood the abrasion of rubbing with a finger, showing that the addition of the UV initiator to the image and exposure to UV light cured the liquid to a black solid.

EXAMPLE II

A UV curable electrophoretic liquid developer was prepared as described in Example I except that the Sterling carbon black was replaced by Copper Phthalocyanine, a cyan pigment available from BASF, Holland, Mich. An electrostatic image was created on dielectric paper by the procedure described in Example I, and the electrostatic image was developed with this cyan liquid developer by the procedure described in Example I except the background bias was set to +50 volts. The developed image was cured to a cyan solid by the procedure described in Example I. The cured image was dry to the touch and withstood the abrasion of rubbing with a finger. The resistivity of the developer (at 5 volts, 5 hertz) was $6.8\times1010$ ohm-cm.

EXAMPLE III

A UV curable electrophoretic liquid developer was prepared as described in Example I except that the Sterling carbon black was replaced by Diarlylide Yellow, a yellow pigment available from Sun Chemical, Cincinnati, Ohio. An electrostatic image was created on dielectric paper by the procedure described in Example I, and the electrostatic image was developed with this yellow liquid developer by the procedure described in Example I. The developed image cured to a yellow solid by the procedure described in Example I. The image was dry to the touch and withstood the abrasion of rubbing with a finger. The resistivity of the developer (at 5 volts, 5 hertz)was $4.1\times10^{10}$ohm-cm.

EXAMPLE IV

A UV curable electrophoretic liquid developer was prepared by charging a 4 ounce glass bottle with 10 grams of Hostaperm Pink CM29701 pigment, available from BASF, Holland, Mich., 90 grams of decyl vinyl ether (Decave), and 100 grams of ⅛ inch stainless steel shots and rolling the dispersion overnight. Five grams of the resulting concentrate was then diluted with 45 grams of decyl vinyl ether (Decave) and 50 grams of 1,4,-bis[(vinyloxy)methyl)]-cyclohexane (Rapi-Cure CHVE). Subsequently, one gram of a 0.1 percent by weight solution of a charge director, Basic Barium Petronate, in dodecane was added to the diluted concentrate to form a developer. The resistivity of the developer (at 5 volts, 5 hertz) was $2.0\times10^{11}$ ohm-cm. An electrostatic image was created by the procedure described in Example I: except that the power supply was set to deliver −500 volts to the coated surface of the dielectric paper. The electrostatic image was developed with this developer composition by the procedure described in Example I except the background bias was set to −100 volts. The developed image was cured to a magenta solid by the procedure described in Example I.

A second electrostatic image was created under the same conditions and developed with the same developer except the bias voltage was set to −150 volts. This magenta image was cured to a magenta solid by the procedure described in Example I. The image was dry to the touch and withstood the abrasion of rubbing with a finger.

EXAMPLE V

A UV curable electrophoretic liquid developer was prepared by the procedure described in Example IV except that 2 grams of the 0.1 percent by weight solution of Basic Barium Petronate in dodecane was used. The resistivity of the developer (at 5 volts, 5 hertz) was $1.1\times10^{11}$ ohm-cm. An electrostatic image was created and developed with this developer composition as described in Example IV with the background bias voltage set to −100 volts, and the visible image was cured to a magenta solid by the procedure described in Example I. The image was dry to the touch and withstood the abrasion of rubbing with a finger.

EXAMPLE VI

A UV curable liquid developer for polarizable liquid development was prepared by (a) making a 30 percent by weight solution of styrene-butylmethacrylate (equal molar) copolymer with a molecular weight of about 50,000 in butanediol divinylether (Rapi-Cure BDVE, available from GAF, Linden N.J.); (b) combining equal parts by weight of this polymer solution and the Hostaperm Pink dispersion described in Example IV; (c) preparing a UV initiator, di(isobutylphenyl)iodinum hexafluoroarsenate as described by Crivello and Lam, *Macromolecules,* 10(6) 1307, 1977, the disclosure of which is totally incorporated herein by reference; and (d) combining 90.92 parts by weight of the polymer dispersion, 4.54 parts of decyl vinyl ether (Decave), 4.54 parts by weight of butanediol divinylether (Rapi-Cure BDVE), and 0.20 parts by weight of the iodinium initiator. The resistivity of this polarizable developer was $7.7\times10^{8}$ ohm-cm and the vicosity as measured on a Brookfield viscometer LVT#2, Brookfield Engineering Laboratories, Stoughton, Mass., at 60 RPM and at 22° C. was 85 centipoise.

An electrostatic image was created on a sheet of dielectric paper as described in Example I except that the potential applied to the carbon fibers was −400 volts. The electrostatic image was then developed into a visible image by applying the polarizable liquid developer to the electrostatic image with a Pamarco Hand Proofer, Pamarco, Inc., Roselie, N.J. using a 150Q gravure and a 0.095 inch by 20 millimeter by 7 millimeter polyurethane doctor blade. The visible magenta image was cured by passing it through a Hanovia UV-6 cure station with the UV lamp set to 300 watts and the conveyor traveling at 20 feet per minute. The image was dry to the touch and withstood the abrasion of rubbing with a finger.

EXAMPLE VII

A UV curable liquid developer for polarizable liquid development was prepared by (a) making a 40 percent by weight solution of styrene-butylmethacrylate (equal molar) copolymer with a molecular weight of about 50,000 in butanediol divinylether (Rapi-Cure BDVE); (b) milling 37.5 grams of Mogul L carbon black, available from Cabot Corporation, Boston, Mass. and 170 grams of decyl vinyl ether (Decave) in an 01S Attritor at ambient temperature for 2 hours and then adding an additional 42.5 grams of decyl vinyl ether; and (c) combining 50 parts by weight of the carbon black dispersion with 10 parts by weight of decyl vinyl ether, 40 parts by weight of the polymer solution, and 0.2 parts by weight of di(isobutylphenyl)iodinum hexafluoroarsenate. The viscosity of the polarizable developer thus formed was 145 centipoise and the resistivity was $1.5\times109$ ohm-cm.

An electrostatic image was created, the electrostatic image was developed, and the developed image was cured as described in Example VI. The resulting black cured image was dry to the touch and withstood the abrasion of rubbing with a finger.

EXAMPLE VIII

Example VII was repeated except that the butanediol divinyl ether used was from BASF Corporation, Parsippany, N.J. The resistivity of the developer was the same but the viscosity was 160 centipoise. An electrostatic image was written and the image developed and cured as described in Example VI. The resulting black cured image was dry to the touch and withstood the abrasion of rubbing with a finger.

EXAMPLE IX

A curable photoelectrophoretic developer is prepared by adding about 7 percent by weight of Locarno Red X-1686, 1-(4'-methyl-5'-chloroazobenzene-2'-sulfonic acid)-2-hydroxy-3-napthoic acid, C.I. No. 15865, available from American Cyanamide to a one-to-one mixture of decyl vinyl ether (Decave) and 1,4,-bis[-(vinyloxy)methyl)]-cyclohexane (Rapi-Cure CHVE) and grinding the resulting mixture in a ball mill for about 48 hours to reduce the particle size to an average diameter of less than 1 micron. A photoelectrophoretic imaging appartus of the general type schematically illustrated in FIG. 1*a* of U.S. Pat. No. 3,384,488, the disclosure of which is totally incorporated herein by reference, is used to test the developer with the developer coated on the NESA glass substrate through which exposure is made. The NESA glass surface is connected in series with a switch, a potential source, and the conductive center of a roller having a coating of baryta paper on its surface. The roller is approximately 2.5 inches in diameter and is moved across the plate surface at about 1.5 centimeters per second. The plate employed is roughly 3 inches square and is exposed with a light intensity of about 1800 foot-candles. During imaging, a positive potential of about 2500 volts is imposed on the core of the roller. The gap between the baryta paper surface and the NESA glass surface is about 1 mil. Exposure is made with a 3200° K. lamp through a 0.30 neutral density step wedge filter to measure the sensitivity of the suspension to white light and then Wratton filters 29, 61 and 47*b* are individually superimposed over the light source in separate runs to measure the sensitivity of the suspension to red, green, and blue light, respectively. The images on the baryta paper are overcoated with the initiator solution and cured to a solid as described in Example I.

COMPARATIVE EXAMPLE A

Twenty parts by weight of the concentrated electrophoretic liquid developer described in Example I (prior to dilution to a 2 percent solids solution with decyl vinyl ether and 1,4,-bis[(vinyloxy)methyl)]-cyclohexane was mixed with 40 parts by weight of a 30 percent by weight solution of styrene-butylmethacrylate (equal molar) coploymer with a molecular weight of about 50,000 in decyl vinyl ether (Decave) and with 40 parts by weight of 1,4,-bis[(vinyloxy)methyl)]-cyclohexane (Rapi-Cure CHVE). The resistivity of this developer was $1.8\times10^{11}$ ohm-cm which is within the range of resistivities for developers used in electrophoretic development processes as disclosed herein. The viscosity was 50 centipoise which is outside the range of viscosities for developers used in electrophoretic development processes as disclosed herein. An electrostatic image was created on a sheet of dielectric paper and an attempt was made to develop the electrostatic image into a visible image as described in Example I. The image, however, was unacceptable in that it was only partly formed; the high viscosity of the developer prevented uniform developer flow through the development zone.

COMPARATIVE EXAMPLE B

To an electrophoretic developer prepared as described in Example I was added 0.02 percent by weight UV9310C, a di (-p-dodecylphenyl) iodonium hexafluoroantimonate available from GE. This additive decreased the resistivity from $2.8\times10^{10}$ ohm-cm, which is within the range of resistivities for developers used in electrophoretic development processes as disclosed herein, to $2.5\times10^{9}$, which is outside this range. An electrostatic image was created and an attempt was made to develop the electrostatic image into a visible image as described in Example I. No image, however, was formed. The low resistivity of this liquid developer resulted in the electrostatic image being destroyed before the toner particles could develop a visible image.

COMPARATIVE EXAMPLE C

To 43.5 parts by weight of the carbon black in decyl vinyl ether dispersion prepared in Example VII was added 21.7 parts more of decyl vinyl ether and 34.8 parts of 1,4,-bis[(vinyloxy)methyl)]-cyclohexane. The resistivity of this developer was $2.6\times10^{10}$ and was within the range of resistivities for liquid developers used in polarizable liquid development processes as disclosed herein, but the viscosity of the developer was 20 centipoise, which was outside the range of viscosities for liquid developers used in polarizable liquid development processes as disclosed herein. An electrostatic image was created on dielectric paper and an attempt was made to develop the image as described in Example VI . The low viscosity of the developer, however, resulted in the developer covering the dielectric paper, and the image was nearly impossible to see and unacceptable in that it was difficult to distinguish the image from the background.

COMPARATIVE EXAMPLE D

A di-(tert-butylphenyl) iodonium hexafluoroarsenate UV sensitive polymerization initiator was prepared by the method described by Crivello and Lam, *Macromolecules,* 10(6) 1307 (1977), the disclosure of which is totally incorprated herein by reference. A dispersion containing 35 grams of decyl vinyl ether (Decave, obtained from International Flavors & Fragrances, Inc., New York, N.Y.) and 0.09 gram of di-(tert-butylphenyl) iodonium hexafluoroarsenate was prepared by ball milling these materials in a 4 ounce glass jar with 320 grams of 3/16 inch stainless steel shots for 16 hours. To the milled dispersion was then added 14.91 grams of 1,4-bis[(vinyloxy)methyl]-cyclohexane (Rapi-Cure CHVE, available from GAF Corporation, Wayne, N.J.) and the milling continued for 5 more minutes. The resistivity of the dispersion was measured (at 5 volts, 5 hertz) as $1.47\times10^{10}$ ohm-cm, and the viscosity was less than 3 centipoise. A thin coating of the dispersion was made on a clear, 5 mil polyester film (Mylar®, available from E.I. Du Pont De Nemours & Company, Wilmington, Del.) by coating with a wire wound rod (AR-4110 Leneta wire-cator available from Pacific Scientific Corporation, Silver Spring, Md. The coating on the polyester was placed on a conveyor running at 18 feet per minute and exposed to a 6 inch medium-pressure mercury-vapor UV light operating at 6.2 amps AC rms and 270 volts AC rms (Hanovia UV-6 laboratory oven, Newark, N.J.). The coating remained a liquid, indicating that di-(tert-butylphenyl) iodonium hexafluoroarsenate did not initiate polymerization of the selected liquid vehicle under these conditions, and that accordingly this combination of liquid vehicle and initiator under the reported conditions is unsuitable for a curable liquid developer.

COMPARATIVE EXAMPLE E

A diphenyl iodonium hexafluoroarsenate UV sensitive polymerization initiator was prepared by the method described by Crivello and Lam, *Macromolecules,* 10(6) 1307 (1977), the disclosure of which is totally incorprated herein by reference. A dispersion containing 42 grams of decyl vinyl ether (Decave, obtained from International Flavors & Fragrances, Inc., New York, N.Y.) and 0.3 gram of diphenyl iodonium hexafluoroarsenate was prepared by ball milling these materials in a 4 ounce glass jar with 320 grams of 3/16 inch stainless steel shots for 16 hours. To the milled dispersion was then added 17.7 grams of 1,4-bis[(vinyloxy)methyl]-cyclohexane (Rapi-Cure CHVE, available from GAF Corporation, Wayne, N.J.) and the milling continued for 5 more minutes. The resistivity of the dispersion was measured (at 5 volts, 5 hertz) as $8.4\times10^{10}$ ohm-cm, and the viscosity was less than 3 centipoise. A thin coating of the dispersion was made on a clear, 5 mil polyester film (Mylar®, available from E.I. Du Pont De Nemours & Company, Wilmington, Del.) by coating with a wire wound rod (AR-4110 Leneta wire-cator available from Pacific Scientific Corporation, Silver Spring, Md.). The coating on the polyester was placed on a conveyor running at 18 feet per minute and exposed to a 6 inch medium-pressure mercury-vapor UV light operating at 6.2 amps AC rms and 270 volts AC rms (Hanovia UV-6 laboratory oven, Newark, N.J.). The coating remained a liquid, indicating that diphenyl iodonium hexafluoroarsenate did not initiate polymerization of the selected liquid vehicle under these conditions, and that accordingly this combination of liquid vehicle and initiator under the reported conditions is unsuitable for a curable liquid developer.

EXAMPLE X

Di-(tert-butylphenyl) iodonium hexafluoroarsenate (1.6 grams) was dissolved in 90.4 grams of reagent grade methylene chloride (obtained from Fisher Scientific, Fair Lawn, N.J.). Thereafter, 8.0 grams of Mogul L Carbon Black (obtained from Cabot Corporation, Boston, Mass.) was added and the resulting dispersion was shaken for 20 minutes. The methylene chloride was subsequently removed by evaporation in a Rotavapor (RE 121 from Büchi, Switzerland) at a temperature of from about 45° to 50° C. under vacuum for 15 minutes to produce a dry initiator-powder mixture (Initiator-Powder A).

Thereafter, 35 grams of Decave, 14.5 grams of CHVE, and 0.5 gram of Initiator-Powder A were mixed. The resistivity of the mixture was measured at $9.2\times10^{9}$ ohm-cm (at 5 V, 5 hz), and the viscosity was less than 3 centipoise. A thin layer of the mixture was coated as described in Comparative Example D and the coating was exposed to UV light as described in Comparative Example D. The coating cured to form a dry layer, indicating the effectiveness of this initiator to cure the liquid vehicle when contained on the surfaces of solid particles. With a viscosity of less than 3 centipoise and a resistivity greater than $5\times10^{9}$ ohm-cm, this formulation is suitable for use as a curable electrophoretic liquid developer upon the addition of a charge control agent.

EXAMPLE XI

A mixture was prepared by mixing together 35 grams of Decave, 14.75 grams of CHVE, and 0.25 gram of Initiator-Powder A (prepared as described in Example X). The resistivity of the mixture was measured at $1.2\times10^{10}$ ohm-cm (at 5 V, 5 hz), and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^{9}$ ohm-cm, this formulation is suitable for use as a curable electrophoretic liquid developer upon the addition of a charge control agent.

EXAMPLE XII

A mixture was prepared by mixing together 42 grams of Decave, 17.4 grams of CHVE, 0.3 gram of Initiator-Powder A (prepared as described in Example X), and 0.3 gram of Mogul L carbon black. The resistivity of the mixture was measured at $9.7\times10^{9}$ ohm-cm (at 5 V, 5 hz), and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^{9}$ ohm-cm, this formulation is suitable for use as a curable electrophoretic liquid developer upon the addition of a charge control agent.

EXAMPLE XIII

Diphenyl iodonium hexafluoroarsenate (1.5 grams) was dissolved in 45.0 grams of reagent grade methanol (obtained from Fisher Scientific, Fair Lawn, N.J.). Thereafter, 3.5 grams of Mogul L Carbon Black was added and the resulting dispersion was shaken for 45 minutes. The methanol was then removed by evaporation in the Rotavapor at a temperature of from 45° to 50° C. under vacuum for 15 minutes to produce a dry initiator-powder mixture (Initiator-Powder B).

Thereafter, 42 grams of Decave, 17.1 grams of CHVE, and 0.9 gram of Initiator-Powder B were mixed together. The resistivity of the mixture was measured at $1.8\times10^{10}$ ohm-cm (at 5 V, 5 hz), and the viscosity was less than 3 centipoise. A thin layer of the mixture was coated as described in Comparative Example D and the coating was exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^{9}$ ohm-cm, this formulation is suitable for use as a curable electrophoretic liquid developer upon the addition of a charge control agent.

EXAMPLE XIV

Di-(tert-butylphenyl) iodonium hexafluoroarsenate (1.6 grams) was dissolved in 90.4 grams of reagent grade methylene chloride. Thereafter, 8.0 grams of Hostaperm Pink (magenta pigment particles, obtained from BASF, Holland, Mich.) was added and the resulting dispersion was shaken for 30 minutes. The methylene chloride was then removed by evaporation in the Rotavapor at a temperature of from 45° to 50° C. under vacuum for 15 minutes to produce a dry initiator-powder mixture (Initiator-Powder C).

Thereafter, 42 grams of Decave, 17.4 grams of CHVE, and 0.6 gram of Initiator-Powder C were mixed together. The resistivity of the mixture was measured at $8.6\times10^9$ ohm-cm (at 5 V, 5 hz), and the viscosity was less than 3 centipoise. A thin layer of the mixture was coated as described in Comparative Example D and the coating was exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XV

To a 4 ounce glass jar were added 42.0 grams of Decave, 0.102 gram of di-(tert-butylphenyl) iodonium hexafluoroarsenate, and 0.498 gram of Mogul L (carbon black particles) along with 320 grams of 3/16 inch stainless steel shots. The mixture thus prepared was milled for 16 hours. Subsequently, 17.4 grams of CHVE was added and the mixture was milled for another 5 minutes. The resistivity of the mixture was measured at $9.2\times10^9$ ohm-cm, and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XVI

To a 4 ounce glass jar were added 42.0 grams of Decave, 0.06 gram of di-(tert-butylphenyl) iodonium hexafluoroarsenate, and 0.54 gram of Kaolin (clay, No. 235, available from Duke Scientific, Palo Alto, Calif.) along with 320 grams of 3/16 inch stainless steel shots. The mixture was milled for 16 hours. Subsequently, 17.4 grams of CHVE was added and the mixture was milled for another 5 minutes. The resistivity of the mixture was measured at $6.8\times10^9$ ohm-cm, and the viscosity was less than 3 centipoise. A thin layer of the mixture was coated as described in Comparative Example D and the coating was exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XVII

To a 4 ounce glass jar were added 42.0 grams of Decave, 0.06 gram of di-(tert-butylphenyl) iodonium hexafluoroarsenate, and 0.54 gram of PV Fast Blue A2R (blue pigment particles, obtained from American Hoechst Corporation, North Somerville, N.J.) along with 320 grams of 3/16 inch stainless steel shots. The mixture was milled for 16 hours. Subsequently 17.4 grams of CHVE was added and the mixture milled for another 5 minutes. The resistivity of the mixture was measured at $7.3\times10^9$ ohm-cm, and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XVIII

To a 4 ounce glass jar were added 42.0 grams of Decave, 0.06 gram of di-(tert-butylphenyl) iodonium hexafluoroarsenate, and 0.54 gram of Titanium Oxide P-25 (metal oxide particles, obtained from Degussa Corporation, Teterboro, N.J.) along with 320 grams of 3/16 inch stainless steel shots. The mixture was milled for 16 hours. Subsequently, 17.4 grams of CHVE was added and the mixture was milled for another 5 minutes. The resistivity of the mixture was measured at $7.0\times10^9$ ohm-cm, and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XIX

To a 4 ounce glass jar were added 42.0 grams of Decave, 0.06 gram of di-(tert-butylphenyl) iodonium hexafluoroarsenate, and 0.54 gram of Aerosil R 972 (silica particles, obtained from Degussa Corporation, Teterboro, N.J.) along with 320 grams of 3/16 in stainless steel shot. The mixture was milled for 16 hours. Subsequently, 17.4 grams of CHVE was added and the mixture was milled for another 5 minutes. The resistivity of the mixture was measured at $1.5\times10^{10}$ ohm-cm, and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XX

To a 4 ounce glass jar were added 42.0 grams of Decave, 0.3 gram of diphenyl iodonium hexafluoroarsenate, and 0.6 gram of Hostaperm Pink along with 320 grams of 3/16 inch stainless steel shots. The mixture was milled for 16 hours. Subsequently, 17.1 grams of CHVE was added and the mixture was milled for another 5 minutes. The resistivity of the mixture was measured at $4.0\times10^{10}$ ohm-cm, and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XXI

To a 4 ounce glass jar were added 42.0 grams of Decave, 0.3 gram of diphenyl iodonium hexafluoroarsenate, and 0.6 gram of Titanium Oxide P-25 along with 320 grams of 3/16 inch stainless steel shots. The mixture was milled for 16 hours. Subsequently, 17.1 grams of CHVE was added and the mixture milled for another 5 minutes. The resistivity of the mixture was measured at $4.0\times10^{10}$ ohm-cm, and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

EXAMPLE XXII

To a 4 ounce glass jar were added 42.0 grams of Decave, 0.3 gram of diphenyl iodonium hexafluoroarsenate, and 0.6 gram of Quso WR 55, synthetic amorphous precipitated silica (obtained from Degussa Corporation, Teterboro, N.J.) along with 320 grams of 3/16 inch stainless steel shots. The mixture was milled for 16 hours. Subsequently, 17.1 grams of CHVE was added and the mixture milled for another 5 minutes. The resistivity of the mixture was measured at $5.6\times10^{10}$ ohm-cm, and the viscosity was less than 3 centipoise. A thin layer of the mixture was coated as described in Comparative Example D and the coating exposed to UV light as described in Comparative Example D. The coating cured to form a dry layer, indicating the effectiveness of this initiator to cure the liquid vehicle when contained on the surfaces of solid particles. With a viscosity less than 3 centipoise and a resistivity greater than $5\times10^9$ ohm-cm, this formulation is suitable for use as a curable electrophoretic liquid developer upon the addition of a charge control agent.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer for the development of electrostatic latent images comprising a colorant, a substantial amount of a curable liquid vehicle having a viscosity of no more than about 500 centipoise and a resistivity of no less than about $10^8$ ohm-cm, and solid particles containing an initiator substantially insoluble in the liquid vehicle and capable, upon activation, of iniating polymerization of the curable liquid vehicle.

2. A liquid developer according to claim 1 wherein the curable liquid vehicle is selected from the group consisting of ethylenically unsaturated compounds.

3. A liquid developer according to claim 1 wherein the curable liquid vehicle is selected from the group consisting of acrylates, methacrylates, epoxies, vinyl ethers, styrenes, indenes, vinyl acetals, ketene acetals, aliphatic $\alpha$-olefins, and mixtures thereof.

4. A liquid developer according to claim 1 wherein the curable liquid vehicle comprises molecules having moieties selected from the group consisting of cinnamic groups, fumaric groups, maleic groups, maleimido groups, and mixtures thereof.

5. A liquid developer according to claim 1 wherein the solid particles are selected from the group consisting of silicas, clays, diatomaceous earth, metal oxides, metal carbonates, metal sulfates, alumina, glass, starch, comminuted cellulose, carbon blacks, graphites, diamond, polymers, latexes, pigment particles, and mixtures thereof.

6. A liquid developer according to claim 1 wherein the solid particles have an average particle diameter of less than about 50 microns.

7. A liquid developer according to claim 1 wherein the solid particles have an average particle diameter of less than about 10 microns.

8. A liquid developer according to claim 1 wherein the solid particles have an average particle diameter of less than about 1 micron.

9. A liquid developer according to claim 1 wherein the initiator is selected from the group consisting of diaryl iodonium salts and their derivatives, triaryl sulfonium salts and their derivatives, triaryl phosphonium salts and their derivatives, and mixtures thereof.

10. A liquid developer according to claim 1 wherein the initiator is present in an amount of from about 0.005 to about 5 percent by weight of the developer.

11. A liquid developer according to claim 1 wherein the solid particles contain the initiator in an amount of from about 0.05 to about 100 percent by weight of the solid particles.

12. A liquid developer according to claim 1 wherein the solid particles are present in an amount of from about 0.05 to about 5 percent by weight of the developer.

13. A liquid developer according to claim 1 wherein the colorant and the solid particles comprise pigment particles.

14. A liquid developer according to claim 1 wherein the colorant and the solid particles comprise colored particles comprising pigment particles and a polymer.

15. A liquid developer according to claim 1 wherein the curable liquid vehicle has a viscosity of from about 25 to about 500 centipoise and a resistivity of from about $10^8$ to about $10^{11}$ ohm-cm.

16. A liquid developer according to claim 15 wherein the curable liquid vehicle has a viscosity of from about 30 to about 300 centipoise.

17. A liquid developer according to claim 15 wherein the curable liquid vehicle has a resistivity of from about $2\times10^9$ to about $10^{10}$ ohm-cm.

18. A liquid developer according to claim 15 wherein the developer also contains a viscosity controlling agent.

19. A liquid developer according to claim 15 wherein the colorant is a dye.

20. A process for forming images which comprises generating an electrostatic latent image, contacting the latent image with a liquid developer for the development of electrostatic latent images comprising a colorant, a substantial amount of a curable liquid vehicle having a viscosity of no more that about 500 centipoise and a resistivity of no less than about $10^8$ ohm-cm, and solid particles containing an initiator substantially insoluble in the liquid vehicle and capable, upon activation, of initiating polymerization of the curable liquid vehicle, and curing the liquid vehicle remaining on the developed image subsequent to development.

* * * * *